US006283799B1

(12) United States Patent
Fukase et al.

(10) Patent No.: US 6,283,799 B1
(45) Date of Patent: Sep. 4, 2001

(54) MALE AND FEMALE ELECTRICAL CONNECTORS WITH TERMINAL LOCKING DEVICE FOR DETECTING INSERTED CONDITION OF TERMINALS AND CONNECTOR ASSEMBLY

(75) Inventors: Yoshihiro Fukase; Toru Nagano, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/630,391

(22) Filed: Aug. 1, 2000

(30) Foreign Application Priority Data

Aug. 2, 1999 (JP) ..... 11-218677

(51) Int. Cl.[7] ..... H01R 13/514
(52) U.S. Cl. ..... 439/752
(58) Field of Search ..... 439/752

(56) References Cited

U.S. PATENT DOCUMENTS 5,342,223 * 8/1994 Geib ..... 439/752

FOREIGN PATENT DOCUMENTS 0-703-643-A1 9/1995 (EP) .

* cited by examiner

*Primary Examiner*—Brian Sircus
*Assistant Examiner*—Javaid Nasri
(74) *Attorney, Agent, or Firm*—Armstrong, Westerman, Hattori, McLeland & Naughton, LLP

(57) ABSTRACT

A male connector (1A) consists of a male housing body (20) with a terminal receiving cavity (21), which has a hood (22), a female terminal holder (5A) which is assembled to the male housing body (20) inside the hood (22), and a female terminal locking device (4A) slidably engageable in preliminary and full locked positions on the female terminal holder (5A). A female connector (1B) consists of a female housing body (70) with a terminal receiving cavity (71), which has a hood (73), a holder receiving section (72) between the female housing body and the hood, a male terminal holder (5B), and a male terminal locking device (4B) which is slidably engageable in preliminary and full locked positions on male terminal holder (5B). An inserted condition of a terminal in the terminal receiving cavity (21, 71) can be detected. The male and female connectors (1A, 1B) are coupled to provide an electrical connector assembly.

8 Claims, 18 Drawing Sheets

SEE FIG.17A
5B
100a
97'
100
92
102
91a
93
106
103
96
105
97
107
108a
108
98
110
109
109a
104
91
101'
94'
94
101
4B
Y
Y'

MALE AND FEMALE ELECTRICAL CONNECTORS WITH TERMINAL LOCKING DEVICE FOR DETECTING INSERTED CONDITION OF TERMINALS AND CONNECTOR ASSEMBLY

BACKGROUND OF THE INVENTION

1. Field of the Invention

This invention relates to male and female electrical connectors with a terminal locking device and an electrical connector assembly.

2. Description of the Related Art

A connector 150 as shown in FIG. 30 has conventionally been proposed in EP0703643A1.

The connector 150 consists of a housing body 151 which receives terminals 152 therein, a hood 153 projecting from the housing body 151, a terminal locking device 154 which is mounted on the housing body 151, and a terminal holder 155 for holding the terminals 152 which project from the terminal locking device 154. By sliding the terminal locking device 154 in a direction perpendicular to an insertion direction of terminals 152 into terminal receiving cavities 156 in the housing body 151, the terminals 152 are locked. An operating lever 157 projects forwardly from the terminal locking device 154 and is formed at the tip end with a slide surface 157*a*.

On advancing a mating connector (not shown) into the hood 153 of the connector 150, an inclined surface provided inside the mating connector comes into contact with the slide surface 157*a*. By the inclined surface pressing on the slide surface 157*a*, the terminal locking device 154 is slid to lock the terminals 152 in position.

A drawback to the construction as mentioned above, however, is that the inserted condition of a terminal 152 into the housing body 151 cannot be detected. As a result, there is a danger that an electrical contact failure may be caused after coupling with a mating connector.

SUMMARY OF THE INVENTION

This invention has been accomplished to overcome the above drawback and an object of this invention is to provide male and female electrical connectors with a terminal locking device and a connector assembly which enable to detect an inserted condition therein of a terminal.

In order to attain the object, according to an aspect of this invention, there is provided a male connector with a terminal locking device, which comprises: a female terminal with a shoulder; a male housing body with a terminal receiving cavity formed therein; a holder receiving hood extending in an insertion direction of the female terminal into the terminal receiving cavity from an outer circumferential wall of the male housing body; a female terminal holder having a terminal insertion cavity corresponding to the terminal receiving cavity, which is assembled to the male housing body inside the holder receiving hood; and a female terminal locking device for detecting an inserted condition of the female terminal into the terminal receiving cavity, which is engaged at a side of the female terminal holder toward the male housing body to be slidable in a direction perpendicular to the insertion direction of the female terminal and has a terminal introducing opening corresponding to the terminal receiving cavity.

Preferably, the female terminal locking device comprises a frame body which is engaged in preliminary and full locked positions on the female terminal holder; at least one vertical wall which engages with the shoulder of the female terminal in full locked position, and an operating lever which extends from the frame body in the insertion direction of the female terminal and, when the female terminal locking device is located inside the holder receiving hood, projects outside thereof.

According to another aspect of this invention, there is provided a female connector with a terminal locking device, which comprises: a male terminal with a shoulder; a female housing body with a terminal receiving cavity formed therein; a hood extending in an insertion direction of the male terminal into the terminal receiving cavity from an outer circumferential wall of the female housing body; a holder receiving section formed between the female housing body and the hood; a male terminal holder which is assembled to the female housing body inside the holder receiving section and has a terminal insertion cavity corresponding to the terminal receiving cavity; and a male terminal locking device for detecting an inserted condition of the male terminal into the terminal receiving cavity, which is engaged at a side of the male terminal holder toward the female housing body to be slidable in a direction perpendicular to the insertion direction of the male terminal and has a terminal introducing opening corresponding to the terminal receiving cavity.

Preferably, the male terminal locking device comprises a frame body which is engaged in preliminary and full locked positions on the male terminal holder; at least one vertical wall by which the male terminal passes through the frame body when in preliminary locked position and which extends in a direction perpendicular to a sliding direction of the frame body to engage with the shoulder of the male terminal in full locked position; and at least one operating lever which extends from the vertical wall in the insertion direction of the male terminal.

Preferably, the operating lever is located substantially at a center of the male terminal locking device and projects through the male terminal holder into the hood to prevent distortion of the male terminal when the male terminal is passed through the terminal insertion cavity in preliminary locked position.

According to yet another aspect of this invention, there is provided an electrical connector assembly having a male connector and a female connector, the male connector comprising: a female terminal with a shoulder; a male housing body with a terminal receiving cavity formed therein; a holder receiving hood extending in an insertion direction of the female terminal into the terminal receiving cavity from an outer circumferential wall of the male housing body; a female terminal holder having a terminal insertion cavity corresponding to the terminal receiving cavity, which is assembled to the male housing body inside the holder receiving hood; and a female terminal locking device for detecting an inserted condition of the female terminal into the terminal receiving cavity, which is engaged at a side of the female terminal holder toward the male housing body to be slidable in a direction perpendicular to the insertion direction of the female terminal and has a terminal introducing opening corresponding to the terminal receiving cavity, the female connector comprising: a male terminal with a shoulder; a female housing body with a terminal receiving cavity formed therein; a hood extending in an insertion direction of the male terminal into the terminal receiving cavity from an outer circumferential wall of the female housing body; a holder receiving section formed between the female housing body and the hood; a male terminal holder which is assembled to the female housing body inside the holder receiving section and has a terminal insertion cavity corresponding to the terminal receiving cavity; and a male terminal locking device for detecting an inserted condition of the male terminal into the terminal receiving cavity, which is engaged at a side of the male terminal holder toward the female housing body to be slidable in a direction perpendicular to the insertion direction of the male terminal and has a terminal introducing opening corresponding to the terminal receiving cavity, wherein the female terminal holder further comprises a lever receiving opening for receiving the operating lever of the male terminal locking device when the male connector is fitted in the hood of the female connector to be coupled with the female connector, and the female connector further comprises a lever receiving space formed in the holder receiving section for receiving the operating lever of the female terminal locking device.

Preferably, the female terminal locking device of the male connector further comprises a lever receiving opening formed therein which corresponds to the lever receiving opening of the female terminal holder.

Preferably, the electrical connector assembly further comprises a cam mechanism which allows the female connector and the male connector to be coupled with a low force.

Preferably, the male connector and the female connector are of a waterproof type.

The above and other objects, features and advantages of this invention will become apparent from the following description and the appended claims, taken in conjunction with the accompanying drawings.

DESCRIPTION OF THE PREFERRED EMBODIMENTS

An Embodiment of this invention will now be described with reference to the attached drawings.

FIGS. 1 to 13 show one embodiment of a male connector with a terminal locking device (hereinafter simply referred to as a "male connector") according to this invention.

Figure 1:
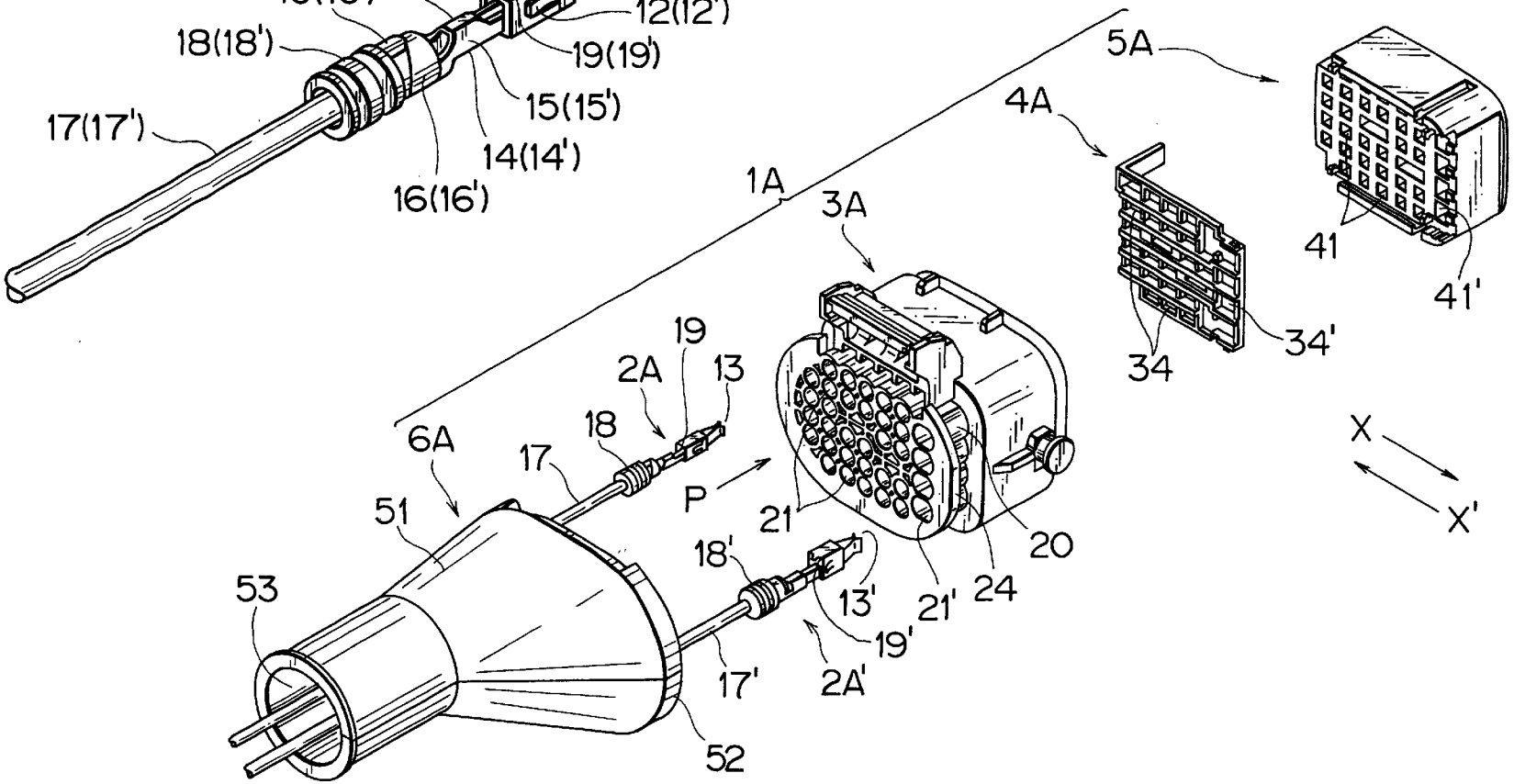
FIG. 1 is an exploded perspective view of a male connector according to an embodiment of this invention.

As shown in FIG. 1, the male connector 1A is made up of female terminals 2A, 2A', a male connector housing 3A, a female terminal locking device 4A, a female terminal holder 5A and a waterproof cover 6A. The male connector housing 3A, female terminal locking device 4A and female terminal holder 5A are made of insulating resin, and the waterproof cover 6A is made of rubber.

Figure 2:
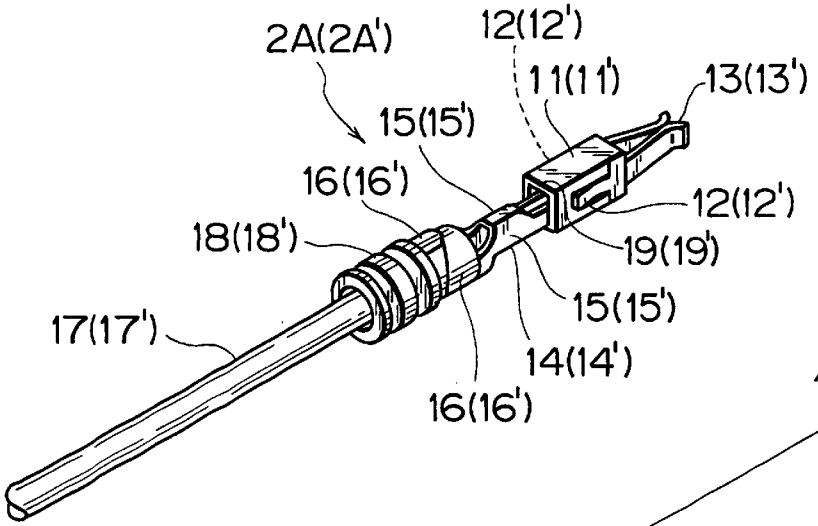
FIG. 2 is an enlarged perspective view of a female terminal as in FIG. 1.

As shown in FIG. 2, the female terminal 2A consists of a block-like terminal body 11, resilient locking pieces 12 cut and raised at both sides of the terminal body 11, a bifurcated contact 13 projecting at the front end of the terminal body 11, wire crimp pieces 15 upstanding on an extension plate 14 extending from the rear end of the terminal body 11, and rubber stopper crimp pieces 16 located on the extension plate 14. The wire crimp pieces 15 are crimped on a wire 17. The rubber stopper crimp pieces 16 are crimped on a rubber stopper 18 which covers the wire 17 crimped. At the rear end of the terminal body 11 is formed a shoulder 19.

The female terminal 2A' in FIG. 1 is larger in size than the female terminal 2A. The female terminal 2A' is configured substantially in the same manner as the female terminal 2A and its description is omitted. Reference characters given to constituent elements of the female terminal 2A are affixed with "'" to show corresponding constituent elements of the female terminal 2A' (cf. FIG. 2).

Figures 3, 3A:
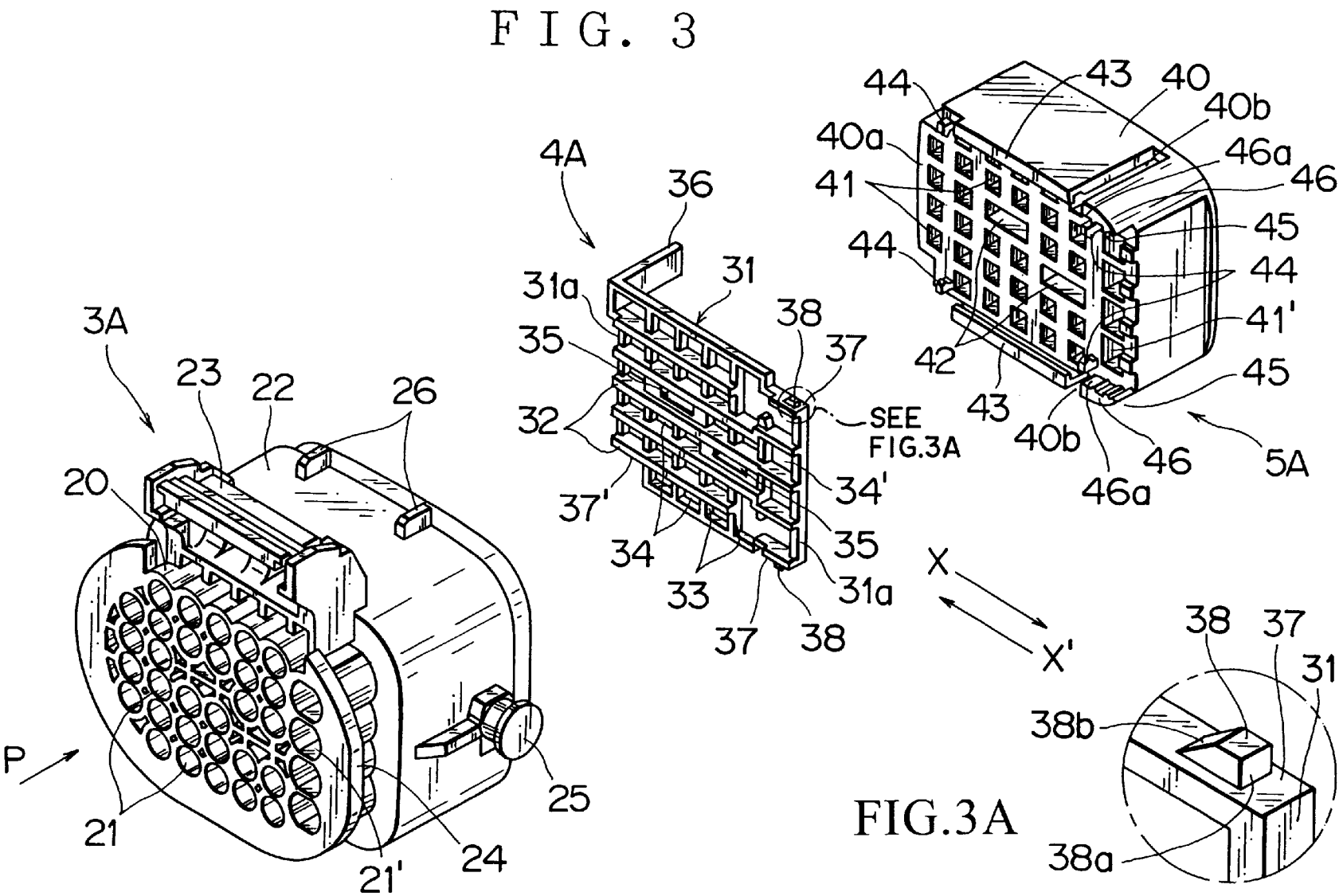
FIG. 3 is an enlarged perspective view of a male housing body, a female terminal locking device and a female terminal holder as in FIG. 1.

As shown in FIGS. 1 and 3, the male connector housing 3A consists of a male housing body 20, a holder receiving hood 22, a locking arm 23 and a collar 24.

The male housing body 20 has a plurality of terminal receiving cavities 21, 21' formed therethrough. Into the terminal receiving cavities 21 are inserted female terminals 2A, and into the terminal receiving cavities 21' are inserted female terminals 2A'. The holder receiving hood 22 extends forwardly (in a female terminal insertion direction P) from the outer circumferential wall of the male housing body 20 which has a cantilever locking arm 23 on top. The collar 24 is provided circumferentially around the rear end of the male housing body 20 except at the top. The hood 22 has drive shafts 25, 25 projecting outwardly at both sides thereof and a pair of guide projections 26, 26 on top.

As shown in FIGS. 1 and 3, the female terminal locking device 4A consists of a rectangular frame body 31, parallel walls 32 and vertical walls 33 which partition the frame body 31, terminal introducing openings 34, 34' and lever receiving openings 35 defined by the parallel walls 32 and vertical walls 33, and an operating lever 36 located at a left side of the frame body 31 to project in the female terminal insertion direction P.

The parallel walls 32 extend in a slide direction (direction X) of the female terminal locking device 4A, and the vertical walls 33 extend perpendicularly to the parallel walls 32. The frame body 31 has indented steps 37, 37 at its right, upper and lower corners and an indented step 37' at its left, lower corner, the indented steps 37, 37 being provided with locking projections 38 each of which has a stopper surface **38*a* and an inclined surface 36*b* spaced in the slide direction. The terminal introducing openings 34, 34' correspond in number and position to the terminal receiving cavities 21, 21' of the male housing body 3A. Two lever receiving openings 35** are formed. The slide direction (direction X) is a direction perpendicular to the female terminal insertion direction (direction P).

Figure 4:
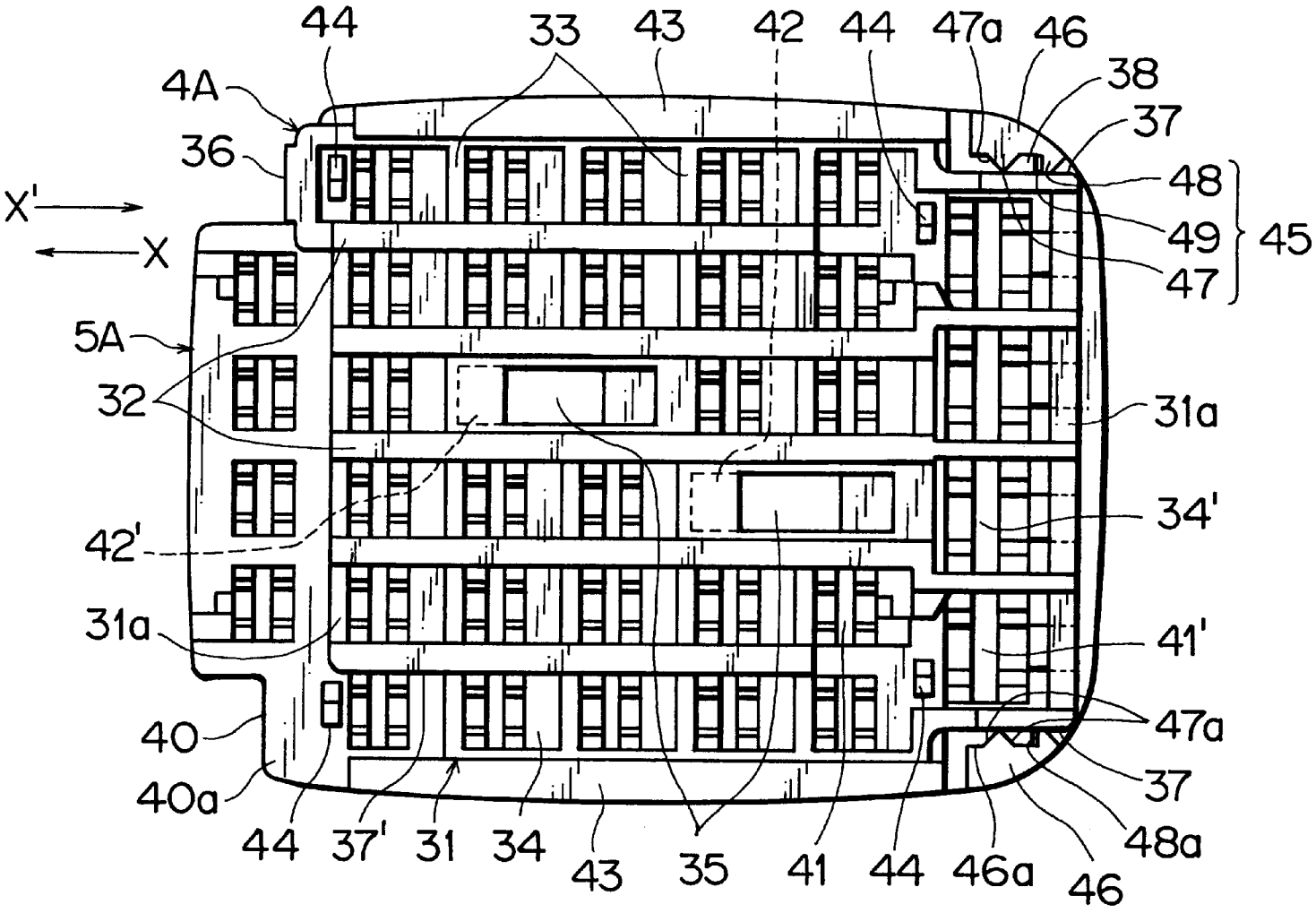
FIG. 4 is an explanatory view of the female terminal locking device slidably engaged in preliminary locked position on the female terminal holder.

As shown in FIGS. 3 and 4, the female terminal holder 5A consists of a block-like holder body 40, terminal insertion cavities 41, 41' and lever receiving openings 42 formed through the holder body 40, a pair of guide rails 43, 43 disposed on a rear surface **40*a* of the holder body 40, holder side locking projection 44 projecting at the rear surface 40*a* of the holder body 40, and locking portions 45 located at a right side on the rear surface 40*a* of the holder body 40**.

The terminal insertion cavities 41, 41' correspond in number and position to the terminal introducing openings 34, 34' of the female terminal locking device 4A, and the lever receiving openings 42 correspond in number and position to the lever receiving openings 35 of the female terminal locking device 4A. The guide rails 43 are L-shaped in cross section and extend in the slide direction (directions X and X') at the upper and lower ends of the rear surface **40*a*. The female terminal locking device 4A is slidable along the guide rails 43**.

As shown in FIGS. 3 and 4, hook-like holder side locking projections 44 are located at upper left and right sides and lower left and right sides on the rear surface **40*a* of the holder body 40, the locking projections 44 projecting rearwardly (in a direction opposite the female terminal insertion direction). The guide rail 43 is located between the upper locking projections 44 and between the lower locking projections 44**.

There are also auxiliary walls 46 on the rear surface **40*a* at right side upper and lower ends, which project rearwardly, and on opposed surfaces 46*a* of the auxiliary walls 46 are formed locking portions 45 engageable with the respective locking projections 38 of the female terminal locking device 4A**.

Each locking portion 45 consists of a positioning projection 47 on the surface **46*a*, a stopper wall 48 spaced in the slide direction from the positioning projection 47, and a projection receiving space 49 located between the positioning projection 47 and the stopper wall 48. The positioning projection 47 and the stopper wall 48 are provided in the form of ribs extending rearwardly from the rear surface 40*a* of the holder body 40. The positioning projection 47 has taper surfaces 47*a*, 47*a* at both sides thereof, and the stopper wall 48 has a stopper surface 48*a*** at a left side thereof.

As shown in FIG. 1, the waterproof cover 6A, which is fitted over the collar 24 of the male housing body 3A, consists of a cover body 51 of watering can shape and a flange 52 provided at a circumferential edge of the cover body 51 for fitting over the collar 24 of the male housing body 3A. The cover body 51 has a hole 53 formed therein.

A method of assembling the male connector 1A during which is detected an incompletely inserted terminal if any will now be described. Description of the case of the female terminal 2A' will be omitted, it being the same as the case of the female terminal 2A.

As shown in FIG. 2, a wire 17 is passed through a rubber stopper 18, and the wire crimp pieces 15 of a female terminal 2A are crimped on the wire 17 which is then inserted through the hole 53 of a waterproof cover 6A.

Figure 5:
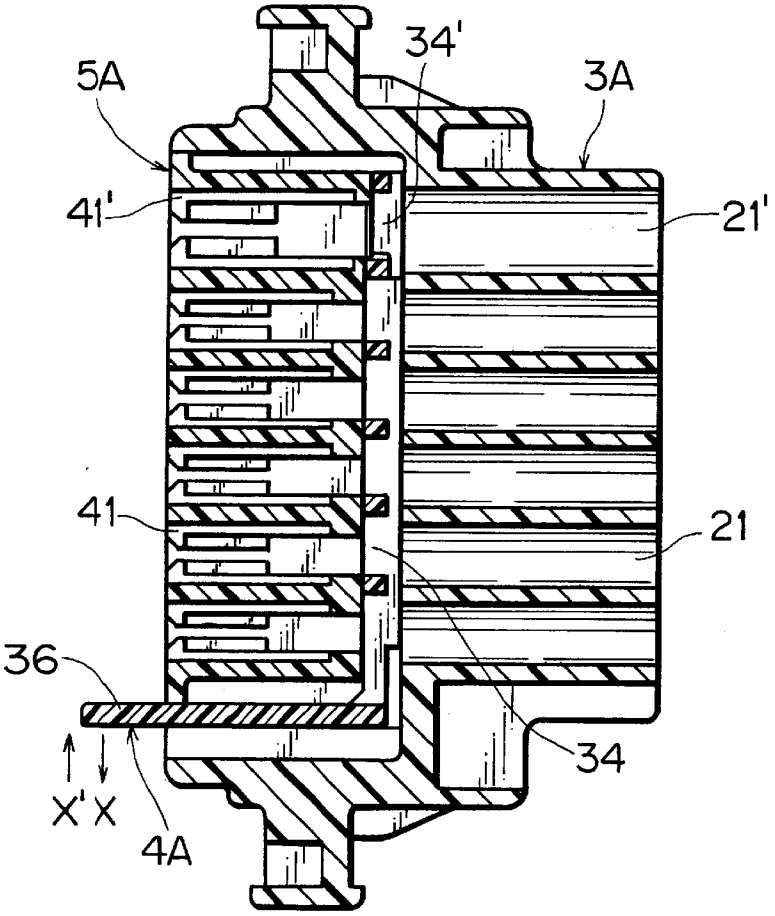
FIG. 5 is a longitudinal section of the female terminal holder of FIG. 4 mounted in the male housing body.

As shown in FIG. 4, a female terminal locking device 4A is slidably mounted between the guide rails 43 of a female terminal holder 5A. With the female terminal locking device 4A in free condition, the female terminal holder 5A is guided into the holder receiving hood 22 as shown in FIG. 5, with a positioning rib (not shown) of the holder receiving hood 22 slid in a positioning groove **40*b* of the female terminal holder 5A. Engagement of the holder side locking projections 44 with body side locking projections (not shown) of the female housing body 20 allows the female terminal holder 5A to be assembled to the front of the female housing body 20 inside the holder receiving hood 22**.

As shown in FIG. 4, the female terminal locking device 4A is slid to the right (in the direction X') through operation at the operating lever 36 until its locking projections 38 abut against the positioning projections 47 of the female terminal holder 5A. If further pushed in the direction X', the locking projections 38 ride over the respective positioning projections 48 and enter the projection receiving spaces 49, whereby to place the female terminal locking device 4A in preliminary locked position on the female terminal holder 5A. At this time, as shown in FIG. 5, the terminal insertion cavities 41 of the female terminal holder 5A, the related terminal introducing openings 34 of the female terminal locking device 4A and terminal receiving cavities 21 of the female housing body 20 are aligned with one another. Besides, the lever receiving openings 42 of the female terminal holder 5A are aligned with the related lever receiving openings 35 of the female terminal locking device 4A. The operating lever 36 of the female terminal locking device 4A projects forwardly from the left side of the female terminal holder 4A.

Figure 6:
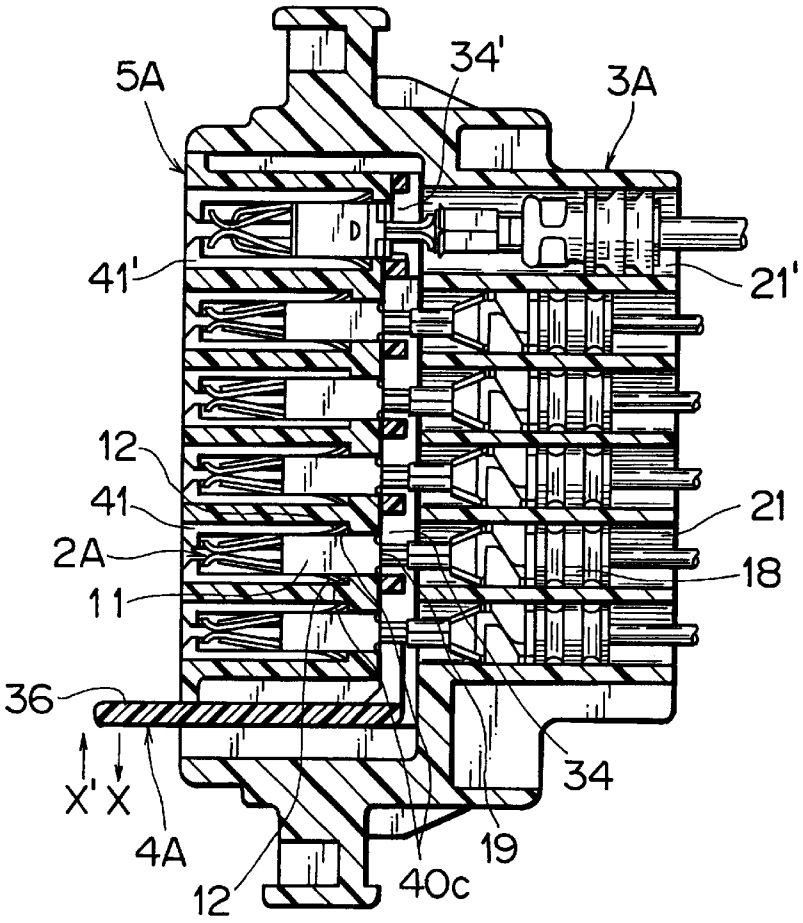
FIG. 6 is a view similar to FIG. 5, with female terminals inserted.
Figure 7:
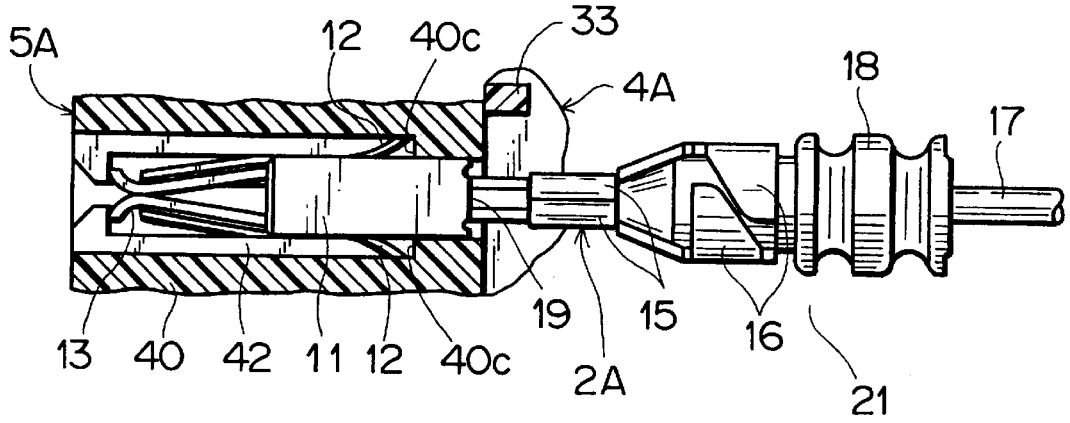
FIG. 7 is an enlarged view of a part of FIG. 6, with a female terminal.

As shown in FIGS. 6 and 7, female terminals 2A attached with a wire 17 are inserted through terminal receiving cavities 21 of the male housing body 20. The bifurcated contact 13 of a female terminal 2A, after inserted through a terminal receiving cavity 21, passes through a terminal introducing opening 34 and a terminal insertion cavity 41 to project outside. The terminal body 11 of the female terminal 2A is inserted from the terminal receiving cavity 21 through the terminal introducing opening 34 into the terminal insertion cavity 41. The female terminal 2A is received with some play inside the terminal insertion cavity 41 and thus slightly movable in the female terminal insertion direction (direction P) and in the opposite direction. On engagement of the resilient locking pieces 12 of the female terminal 2A with locking shoulders 40*c* formed inside the terminal insertion cavity 41, the female terminal 2A is put in prelimiary locked position. The rubber stopper 18 comes into close contact with an inner circumferential surface of the terminal receiving cavity 21.

Then, as shown in FIG. 7, the female terminal locking device 4A is operated at the operating lever 36 and slid to the left (in the direction X) so that its locking projections 38 ride over the positioning projections 47 of the female terminal holder 5A and the female terminal locking device 4A is moved from preliminary locked position to full locked position on the female terminal holder 5A.

Figure 10:
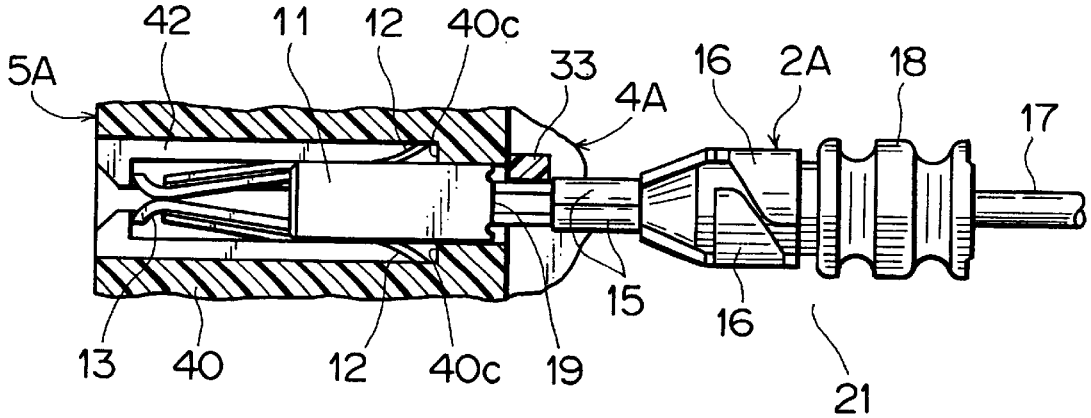
FIG. 10 is an enlarged view of a part of FIG. 9, with a female terminal.
Figure 9:
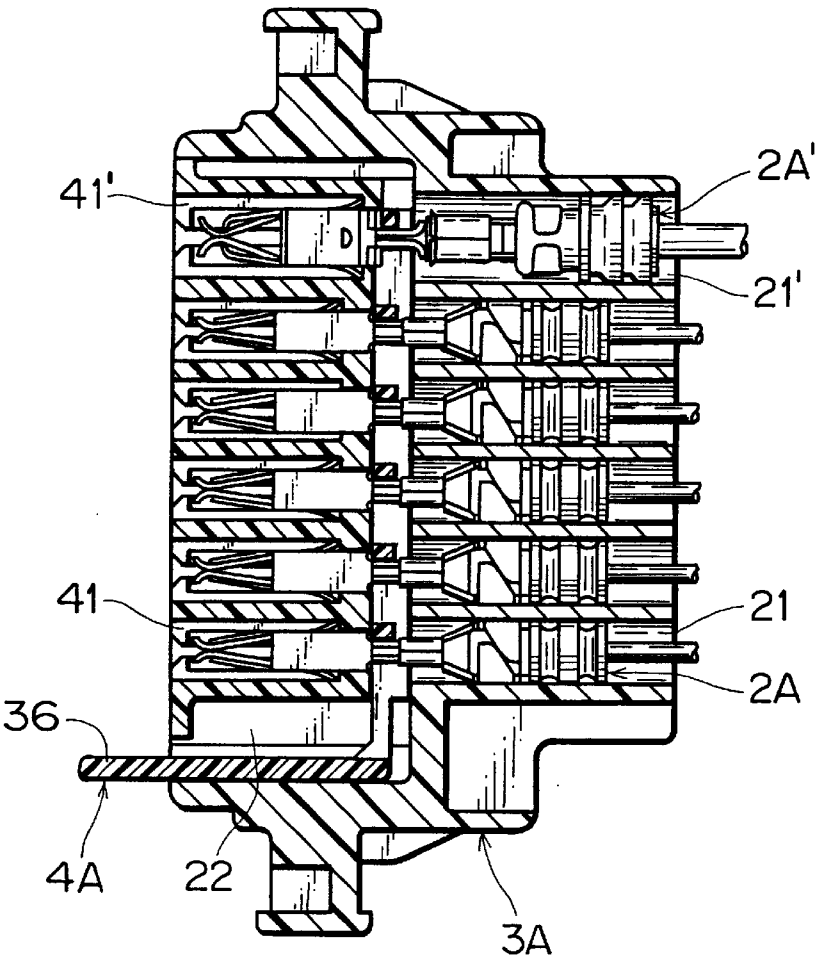
FIG. 9 is a view similar to FIG. 6, with the female terminal locking device slid in the direction X to full locked position to double lock the female terminals.

As shown in FIGS. 9 and 10, if the female terminal 2A has been fully inserted into the terminal receiving cavity 21, the related vertical wall 33 of the female terminal locking device 4A slid or vertical portion 31a of the frame body 31 comes into engagement with the shoulder 19 of the female terminal 2A to double lock the female terminal 2A. In other words, concurrently with fully locking the female terminal locking device 4A, the female terminal 2A is double locked.

Figure 12:
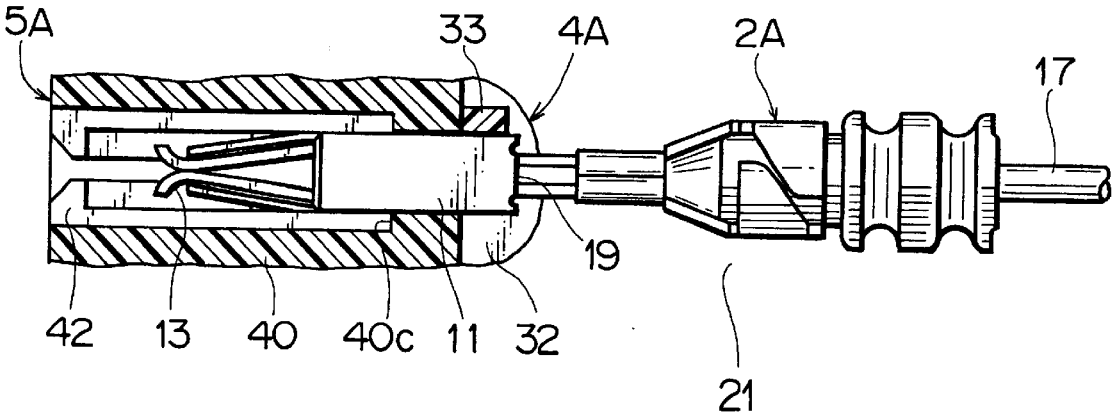
FIG. 12 is an enlarged view of a part of FIG. 11, with the incompletely inserted female terminal.
Figure 13:
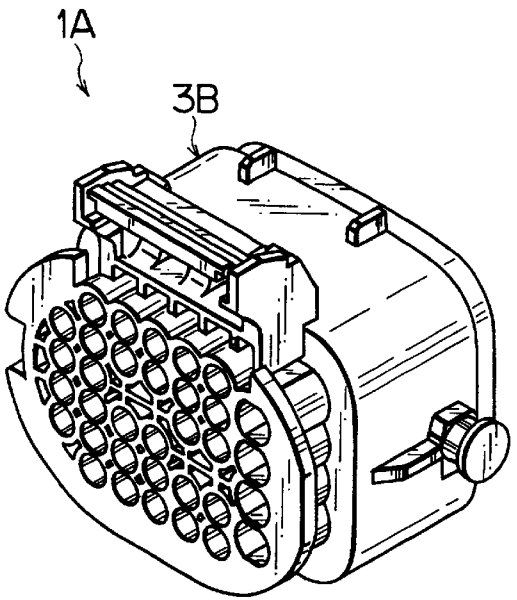
FIG. 13 is a perspective view of an assembled male connector, with a waterproof cover and a female terminal omitted.
Figure 8:
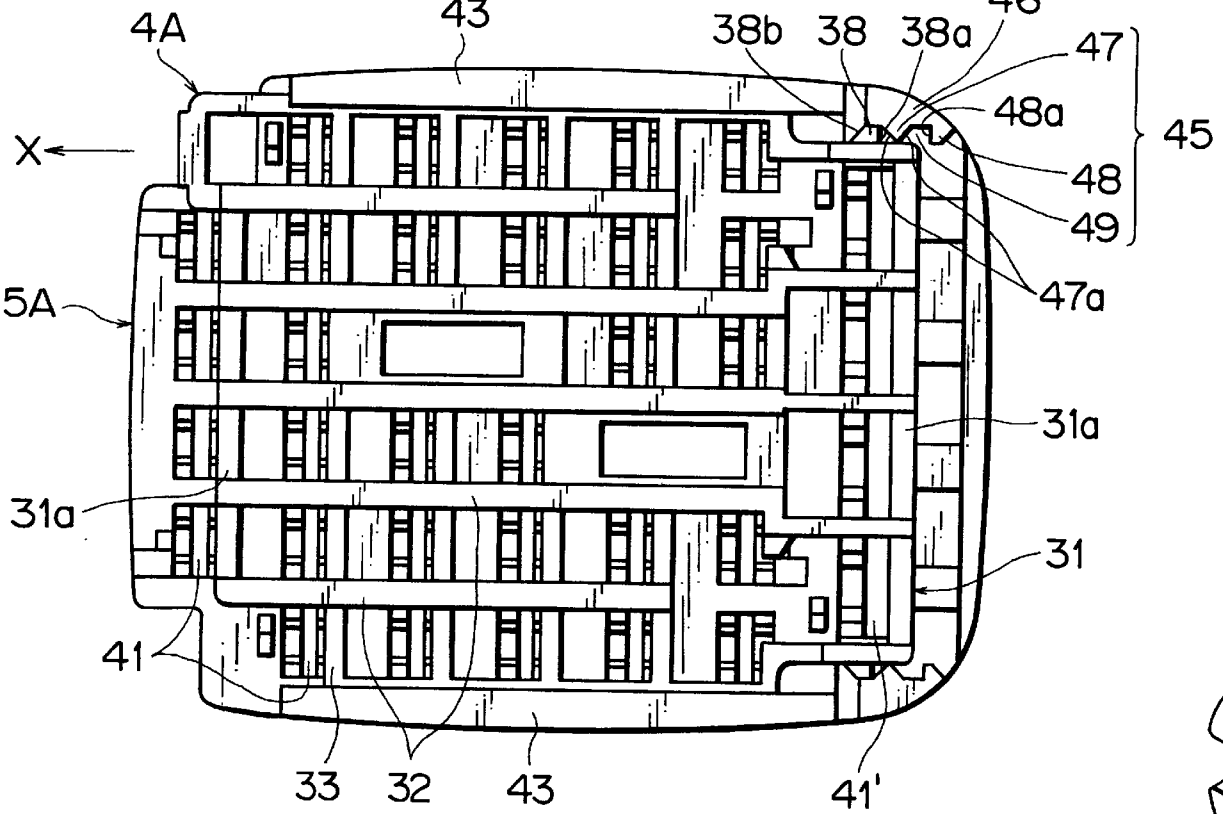
FIG. 8 is a view similar to FIG. 4, with the female terminal locking device slid in a direction X to be moved from preliminary locked position to full locked position.
Figure 11:
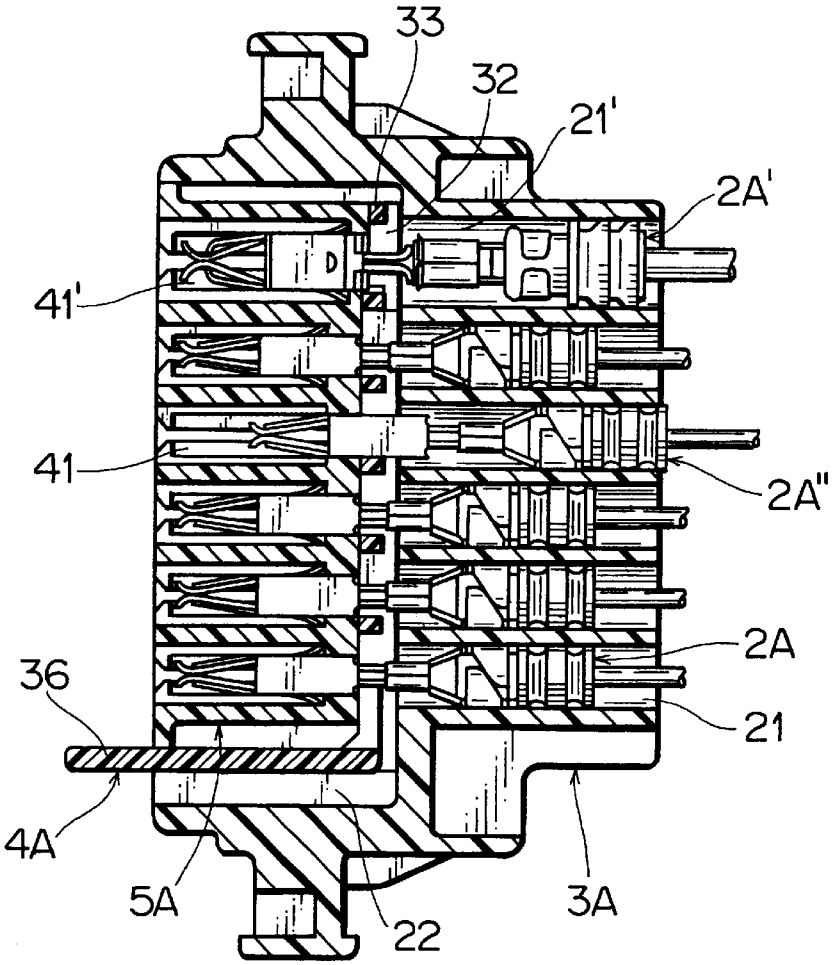
FIG. 11 is a view of female terminals inserted into terminal receiving cavities during the female terminal locking device being in preliminary locked position, with one of the terminals incompletely inserted into the related terminal receiving cavity.

On the other hand, as shown in FIGS. 11 and 12, if the female terminal 2A is in incomplete inserted position in the terminal receiving cavity 21, the vertical wall 33 abuts against the terminal body 11 of the female terminal 2A and is prevented from engaging with the shoulder 19. In other words, the female terminal locking device 4A can not be moved to full locked position on the female terminal holder 5A, and the female terminal 2A is not double locked, thereby enabling to detect the female terminal 2A being in incomplete inserted position in the terminal receiving cavity 21. Such an incompletely inserted female terminal 2A" may thereafter be fully inserted with a jig or the like.

Although dependent on the degree of incomplete insertion into a terminal receiving cavity 21, if the degree is small, such a female terminal 2A may be pushed into the related terminal insertion cavity 41 by a vertical wall 33 of the female terminal locking device 4A or vertical portion 31a of the frame body 31 being slid. In other words, such a female terminal 2A may be automatically moved from incomplete inserted position to full inserted position.

The assembly of the male connector 1A is completed when the flange 52 of a waterproof cover 6A is fitted over the collar 24 of the male housing body 20.

FIGS. 14 to 26 show one embodiment of a female connector with a terminal locking device (hereinafter simply referred to as a "female connector") according to this invention. Components identical with those of the male connector 1A are given like reference characters and their description will be omitted.

Figure 14:
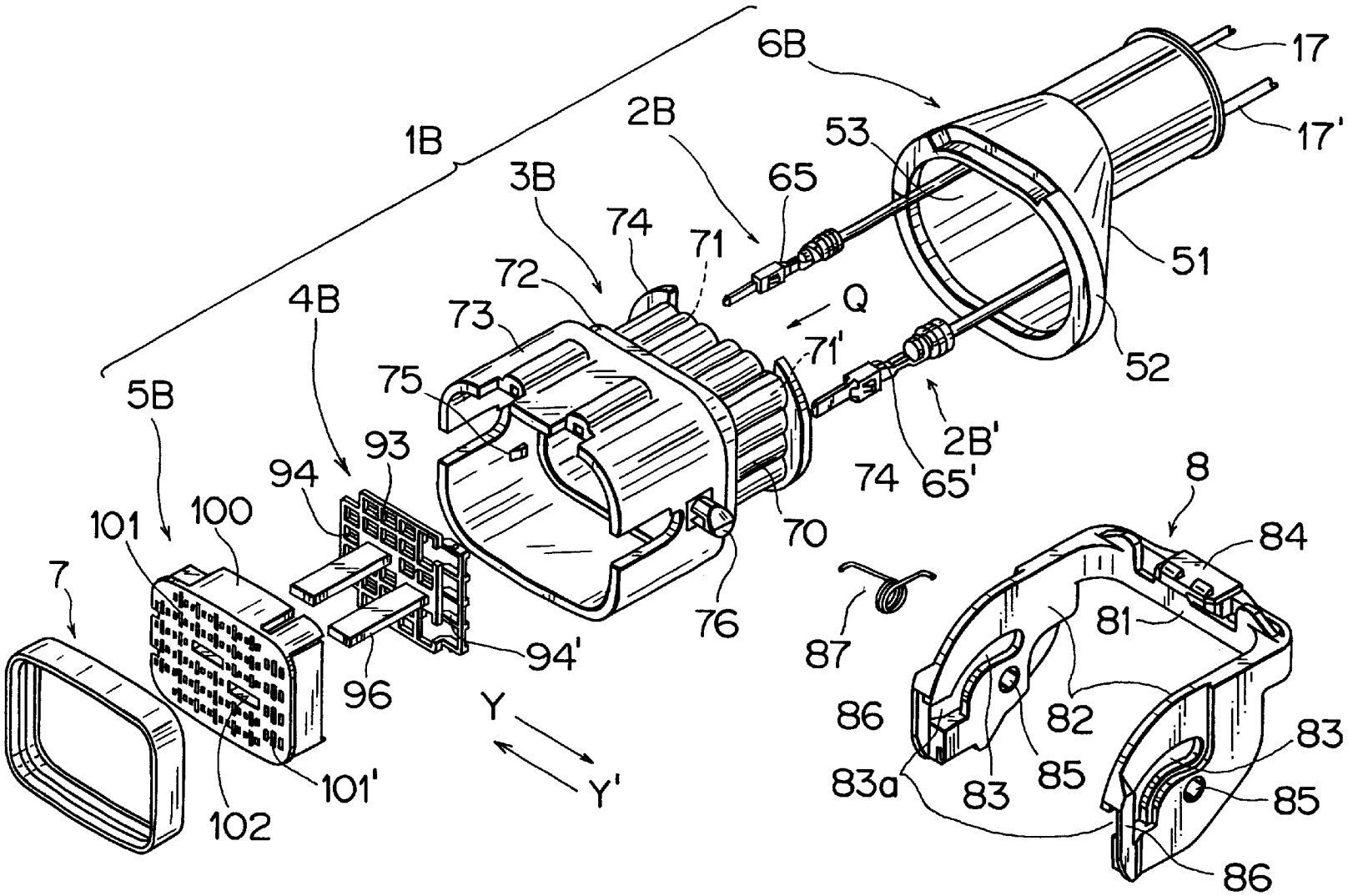
FIG. 14 is an exploded perspective view of a female connector according to an embodiment of this invention.

As shown in FIG. 14, the female connector 1B is made up of male terminals 2B, 2B', a female connector housing 3B, a male terminal locking device 4B, a male terminal holder 5B, a waterproof cover 6B, and a seal packing 7. The female connector housing 3B, male terminal locking device 4B and male terminal holder 5B are made of insulating resin, and the waterproof cover 6B and seal packing 7 are made of rubber.

Figure 15:
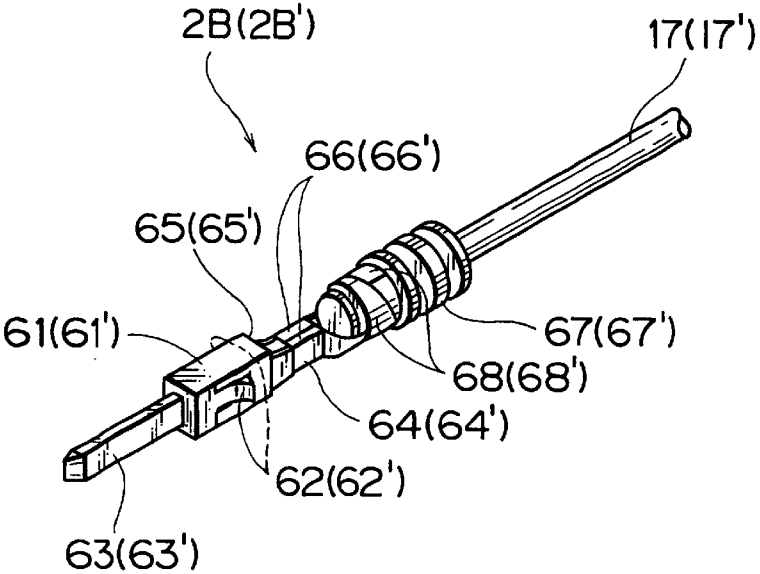
FIG. 15 is an enlarged perspective view of a male terminal as in FIG. 14.

As shown in FIG. 15, the male terminal 2B consists of a block-like terminal body 61, resilient locking pieces 62, 62 cut and raised at both side walls of the terminal body 61, a tab-like contact 63 extending at the front end of the terminal body 61, and an extension plate 64 extending rearwardly from the rear end of the terminal body 61. The male terminal 2B is formed by stamping an electrically conductive metal plate. A shoulder 65 is formed at the rear end of the terminal body 61. The extension plate 64 has a pair of wire crimp pieces 66, 66 for holding a wire 17 and a pair of rubber stopper crimp pieces 68, 68 for holding the rubber stopper 67. After the male terminal 2B is attached with the wire 17 through the crimp pieces 66, 66, the rubber stopper 67 is fitted over the rear end of the male terminal 2B and the crimp pieces 68 are crimped thereon.

The male terminal 2B' in FIG. 14 is larger in size than the male terminal 2B. The male terminal 2B' is configured substantially in the same manner as the male terminal 2B and its description is omitted. Reference characters given to constituent elements of the male terminal 2B are affixed with "'" to show corresponding constituent elements of the male terminal 2B' (cf. FIG. 15).

Figures 16, 16A:
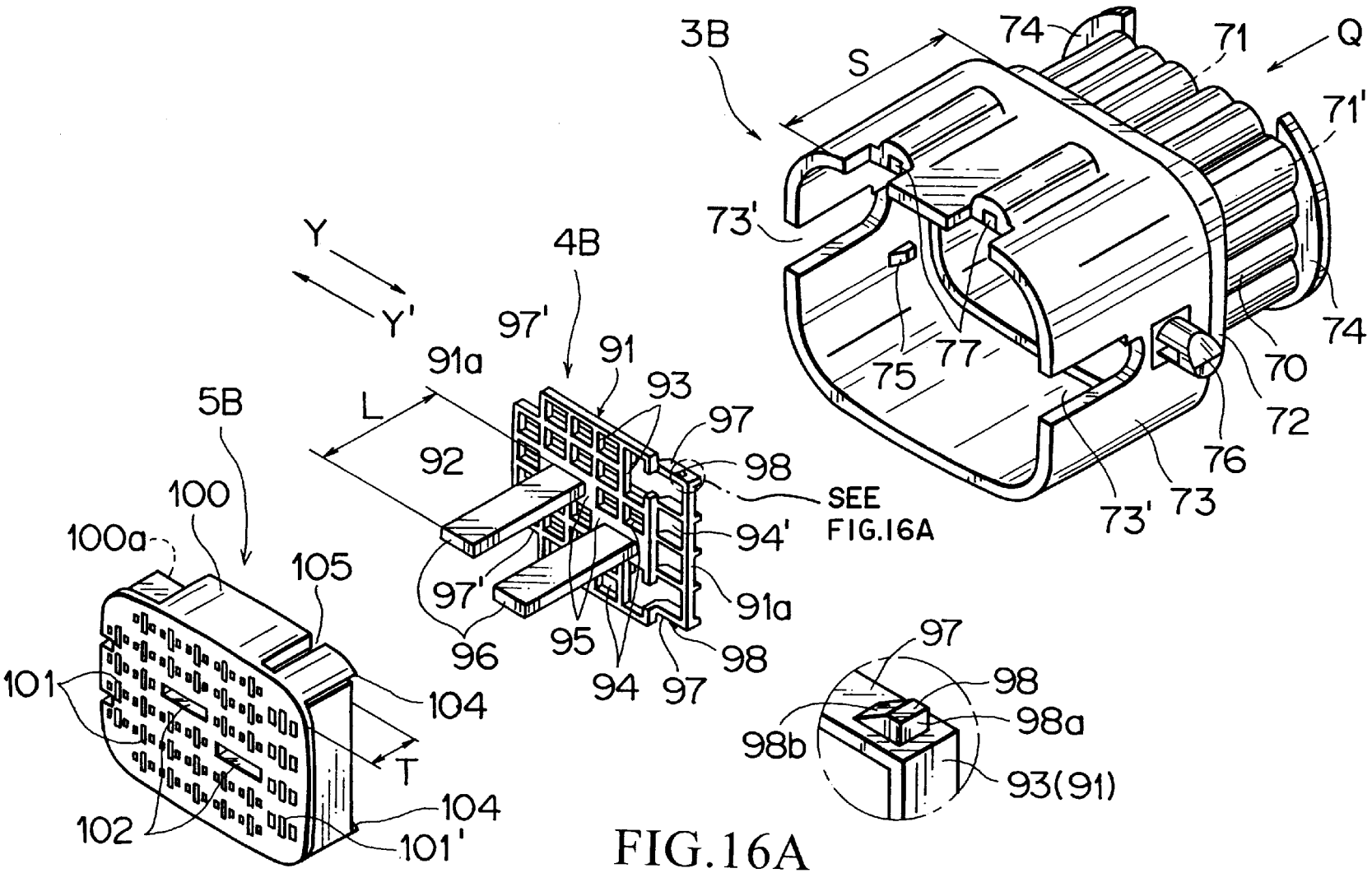
FIG. 16 is a perspective view of a female connector housing, a male terminal locking device and a male terminal holder as in FIG. 14.

As shown in FIGS. 14 and 16, the female connector housing 3B consists of a female housing body 70, a holder receiving section 72, a hood 73 and a collar 74.

The female housing body 70 has a plurality of terminal receiving cavities 71, 71' formed therethrough. Into the terminal receiving cavities 71 are inserted male terminals 2B, and into the terminal receiving cavities 71' are inserted male terminals 2B'.

The holder receiving section 72 extends forwardly (in an insertion direction Q of a male terminal 2B into a terminal receiving cavity 71) from the outer circumferential wall of the female housing body 70 and has a positioning rib (not shown) extending on an upper and lower inner surfaces thereof. The female housing body 70 has at the front thereof upper and lower locking projections (not shown) which project in the direction Q into the holder receiving section 72 and with which the male terminal locking device 4B is assembled.

The hood 73 extends forwardly from the outer circumferential wall of the holder receiving section 72. The hood 73 has introducing cutouts 73', 73' formed at its both side walls, internal projections 75, 75 for the packing 7, and engagement pins 76 provided projecting on its outer surfaces. On its upper wall, the hood 73 has a pair of guide grooves 77 extending in the male terminal insertion direction (direction As shown in FIG. 14, the collar 74 is provided circumferentially around the rear end of the female housing body 70 except at the top, which collar is fitted in the waterproof cover 6B.

An operating cam member 8 is rotatably supported on the engagement pins 76 of the hood 73.

The operating cam member 8 consists of a handle 81, a pair of levers 82, 82 formed integrally at both ends of the handle 81, and a cam groove 83 formed on each lever 82. A fitting plate 84 is disposed substantially at a center of the handle 81. Each lever 82 has a shaft hole 85 in which is fitted the related engagement pin 76. A bridge 86 is provided across an inlet 83*a* of each cam groove 83 to reinforce the lever 82. A coil-like (spiral) spring 87 is interposed between the engagement pins 76 of the hood 73 and the levers 82 of the operating cam member 8. The spring member 87 normally biases the operating cam member 8 in a direction opposite a coupling direction of the female connector 1B (in a clockwise direction on the drawing).

As shown in FIGS. 14 and 16, the male terminal locking device 4B consists of a rectangular frame body 91, a plurality of parallel walls 92 and vertical walls 93 which partition the inside of the frame body 91, a plurality of terminal introducing openings 94, 94' defined by the parallel walls 92 and vertical walls 93, and a pair of operating levers 96, 96 projecting forwardly at intersections 96 of parallel walls 92 and vertical walls 93. The frame body 91 is formed at the four corners with indented steps 97, 97' of which the right side steps 97 each has a locking projection 98.

Each locking projection 98 has a stopper surface 98*a* at an outer side and an inclined surface 98*b* at an inner side in a slide direction (directions Y and Y') of the male terminal locking device 4B. The steps 97 of the frame body 91 are vertically bendable together with the locking projections 98. The terminal introducing openings 94, 94' correspond in number and position to the terminal receiving cavities 71, 71' of the female housing body 4B.

As shown in FIGS. 14 and 16, the pair of operating levers 96, 96 are provided in thin plates and are disposed substantially at a center of the frame body 91, with a suitable spacing therebetween. The length L of the operating levers 96 is larger than the thickness T of the male terminal holder 5B and smaller than the projecting distance S of the hood 73 (T<L<S). By the pair of operating levers 96, 96 projecting forwardly from the male terminal locking device 4B, male terminals 2B are prevented from distortion on passing through terminal introducing openings 94. In other words, if the tab-like contact 63 of a male terminal 2B is passed in an inclined condition through a terminal introducing opening 94, because the tab-like contact 63 comes into contact with one of the operating levers 96, the male terminal 2B is set right (straight in the male terminal insertion direction Q) from the inclined posture. The same also applies for preventing distortion of the female terminal 2B' and its description will be omitted.

As shown in FIGS. 14 and 16, the male terminal holder 5B consists of a block-like holder body 100, a plurality of terminal insertion cavities 101, 101' and a pair of lever receiving openings 102 formed through the holder body 100, a pair of guide rails 103, 103 disposed on a rear surface 100*a* of the holder body 100, and a pair of preliminary locking portions 104 disposed at a left side on the rear surface 100*a*. The holder body 100 has a positioning groove 105 formed on an outer surface thereof, which extends parallel to the male terminal insertion direction Q. The positioning groove 105 is guided on the positioning rib inside the holder receiving section 72.

The terminal insertion cavities 101, 101' correspond in number and position to the terminal introducing openings 94, 94' of the male terminal locking device 4B. The lever receiving openings 102 are laterally elongated to allow a left and right (lateral) movement of the operating levers 96 inserted.

Figures 17, 17A:
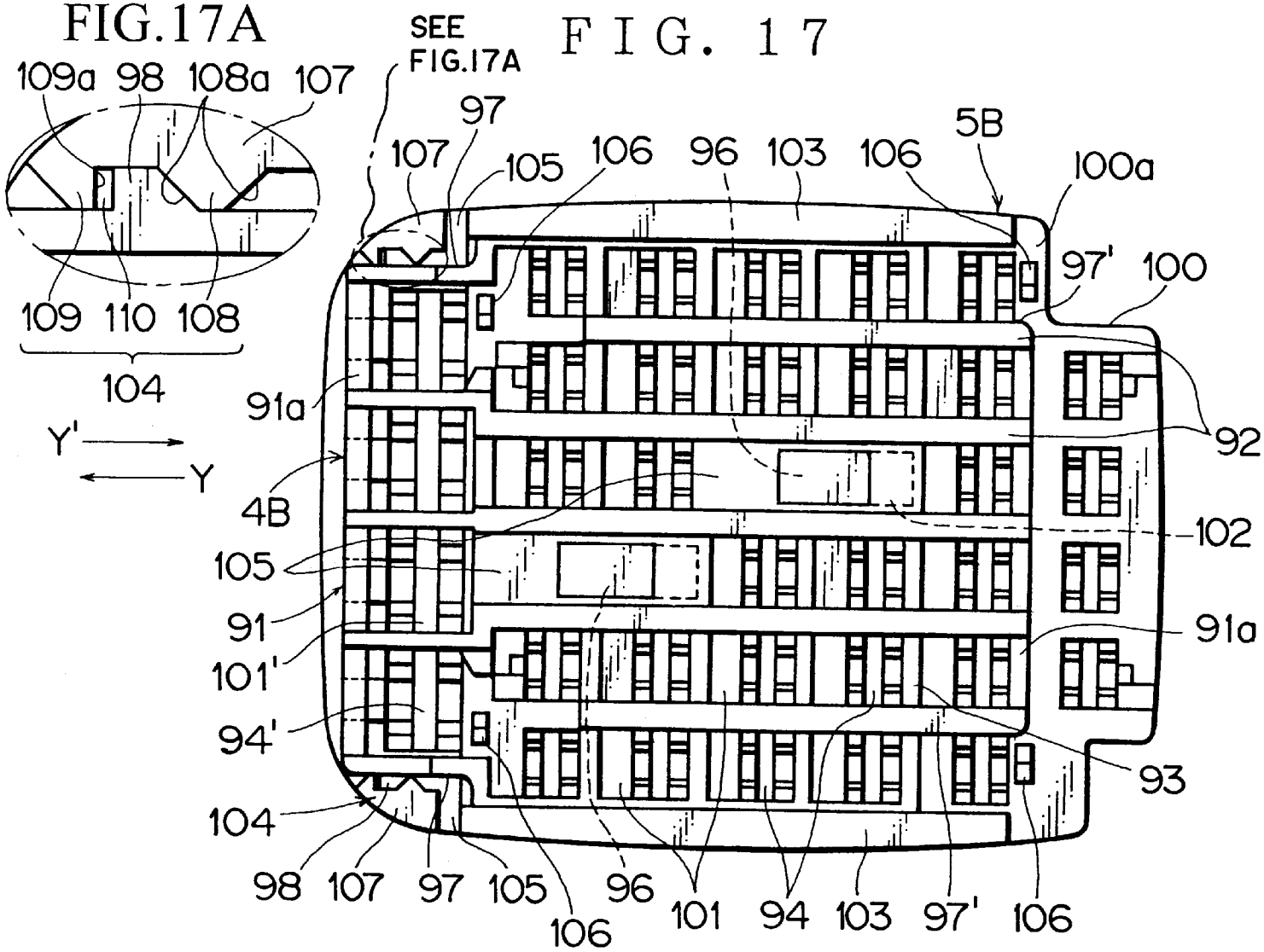
FIG. 17 is an explanatory view of the male terminal locking device slidably engaged in preliminary locked position on the male terminal holder.

As shown in FIGS. 16 and 17, hook-like holder side locking projections 106 are located at upper left and right sides and lower left and right sides on the rear surface 100*a* of the holder body 100, the locking projections 106 projecting rearwardly, and auxiliary walls 107 are located at left side upper and lower ends to extend rearwardly. A guide rail 103 is located between the upper locking projections 106 and between the lower locking projections 106. The holder side locking projections 106 project farther from the rear surface 100*a* of the holder body 100 than the guide rails 103.

As shown in FIG. 17, preliminary locking portions 104 are provided on opposed surfaces 107*a*, 107*a* of the pair of auxiliary walls 107, 107, each locking portion 104 consisting of a positioning projection 108 provided on the surface 107*a*, a stopper wall 109 spaced in the slide direction (directions Y and Y') of the male terminal holder 5B from the positioning projection 108, and a projection receiving space 110 located between the positioning projection 108 and the stopper wall 109.

The positioning projection 108 and the stopper wall 109 are provided in the form of ribs extending rearwardly from the rear surface 100*a* of the holder body 100. The positioning projection 108 has taper surfaces 108*a* at both sides thereof, and the stopper wall 109 has a stopper surface 109*a* at a right side thereof. The engagement of the locking projections 98 in the respective projection receiving spaces 110 places the male terminal locking device 4B in preliminary locked position on the male terminal holder 5B.

As shown in FIG. 14, the seal packing 7 is ring-shaped and inserted into a packing receiving space 78 located between the hood 73 and the holder receiving section 72. The projections 75 inside the hood 73 fixingly hold the seal packing 7 in place.

The waterproof cover 6B is of the same structure as the waterproof cover 6A and its description will be omitted.

A method of assembling the female connector 1B during which is detected an incompletely inserted terminal if any will now be described.

As shown in FIG. 15, the wire crimp pieces 66 of a male terminal 2B are crimped on a wire 17 mounted with a rubber stopper 67, and the rubber stopper crimp pieces 68 of the male terminal 2B are crimped on the rubber stopper 67, so that a male terminal 2B attached with a wire 17 is obtained. A plurality of terminals 2B are in advance inserted through the hole 53 of a waterproof cover 6B. If male terminals 2B' are used, the procedure is almost the same and its description will be omitted.

As shown in FIGS. 14 and 17, the operating levers 96 of a male terminal locking device 4B are inserted through the lever receiving openings 102 of a male terminal holder 5B, and the frame body 91 of a male terminal locking device 4B is engaged between the guide rails 103 to be slidable in the directions Y and Y'. With the operating levers 96 in free condition, the male terminal holder 5B is introduced into the holder receiving section 72, with a positioning rib (not shown) inside the holder receiving section 72 slid in a positioning groove 105 of the male terminal holder 5B. Engagement of the holder side locking projections 106 of the male terminal holder 5B with body side locking projections (not shown) of the female housing body 70 allows the male terminal holder 5B to be assembled to the front of the female housing body 70 inside the holder receiving section 72.

Figure 18:
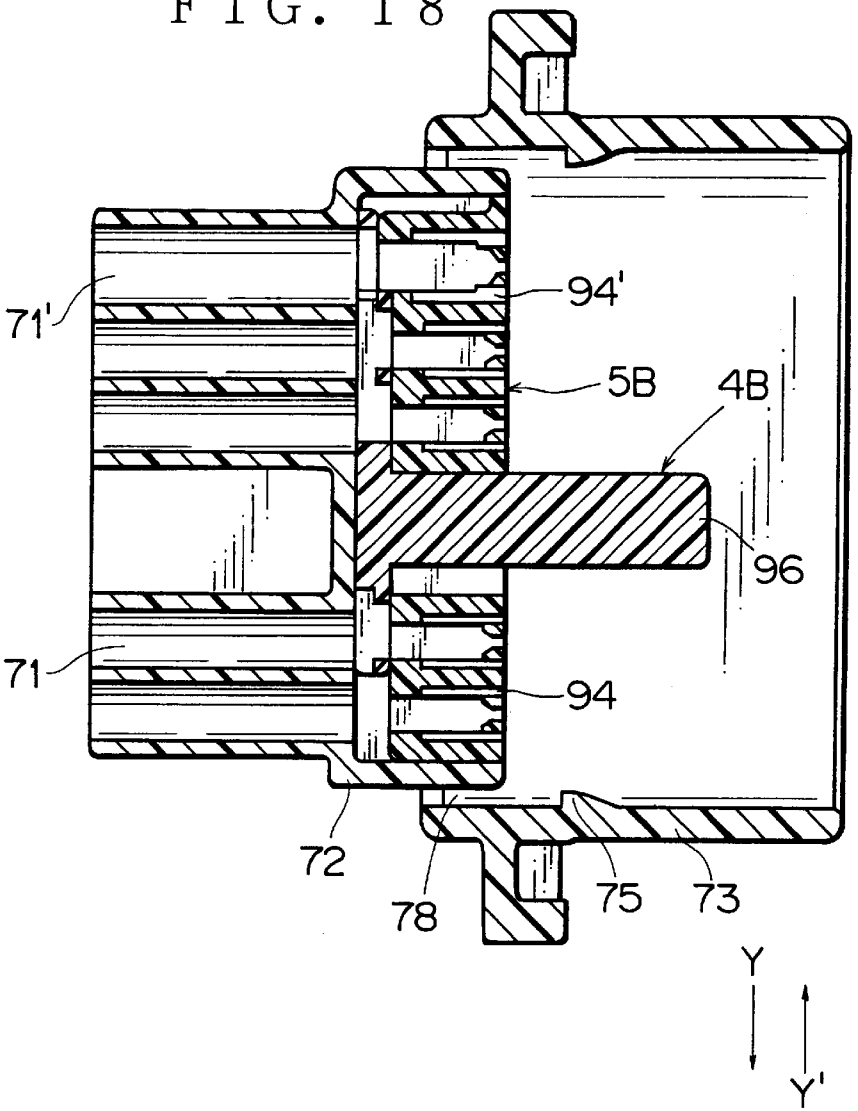
FIG. 18 is a longitudinal section of the male terminal holder of FIG. 17 mounted in the female connector housing.

As shown in FIG. 17, the operating levers 96, which project through the lever receiving openings 102 of the male terminal holder 5B, are slid to the left (in the direction Y). Through resilient deformation at the steps 97 of the frame body 91, the locking projections 98 of the male terminal locking device 4B ride over the related positioning projections 108 and enter the projection receiving spaces 110, whereby to place the female terminal locking device 4B in preliminary locked position on the female terminal holder 5B. At this time, as shown in FIG. 18, the terminal receiving cavities 71 of the female housing body 70, the terminal introducing openings 94 of the male terminal locking device 4B and the terminal insertion cavities 101 of the male terminal holder 5B are aligned with one another.

Figure 19:
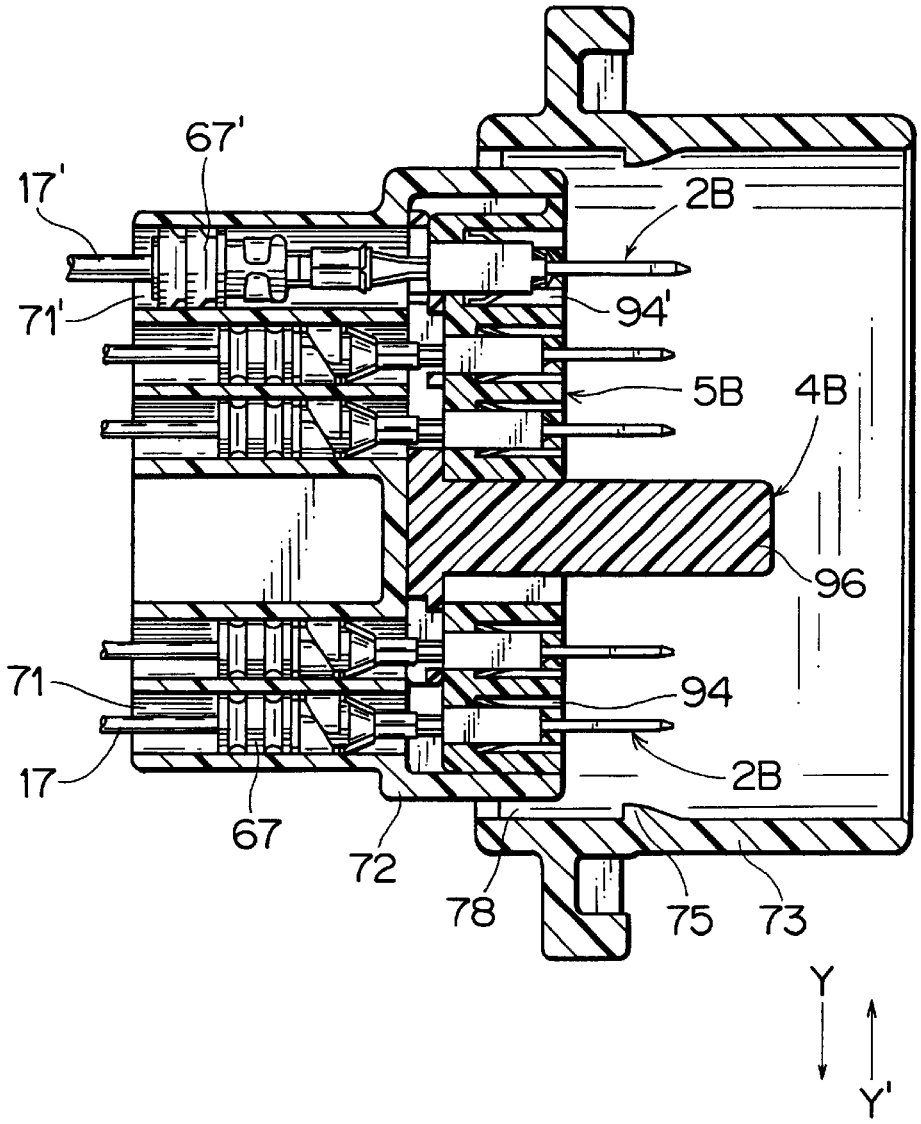
FIG. 19 is a view similar to FIG. 18, with male terminals inserted.
Figure 20:
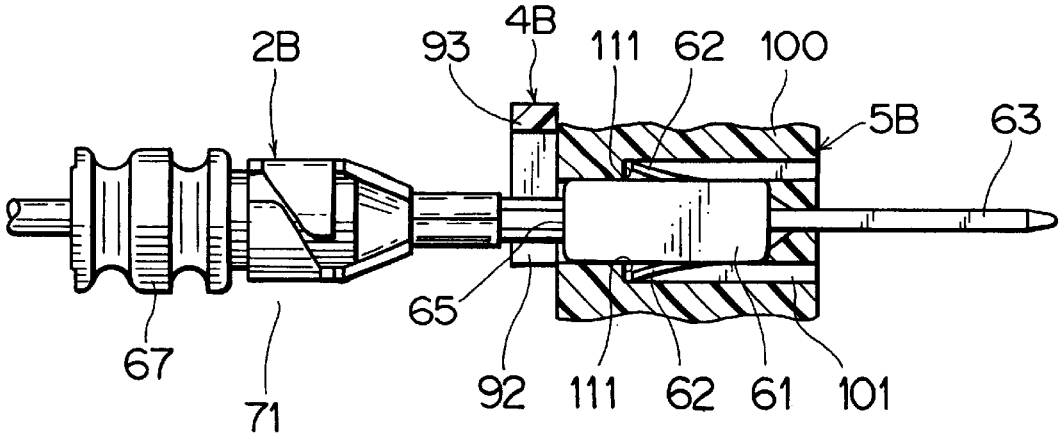
FIG. 20 is an enlarged view of a part of FIG. 19, with a male terminal.

In the preliminary locked position, as shown in FIG. 19, male terminals 2B are inserted from terminal receiving cavities 71 through terminal introducing openings 94 of the male terminal locking device 4B into terminal insertion cavities 101 of the male terminal holder 5B. As shown in FIGS. 19 and 20, the tab-like contacts 63 of male terminals 2B project from the terminal insertion cavities 101, the resilient locking pieces 62 of the male terminals 2B engage with engagement steps 111 formed inside the terminal insertion cavities 101 to have the male terminals preliminarily locked, and rubber stoppers 67 are tightly received inside the terminal receiving cavities 71. The male terminals 2B are received with some play inside the terminal insertion cavities 101 and thus slightly movable therein in the male terminal insertion direction Q and in the opposite direction.

Figure 21:
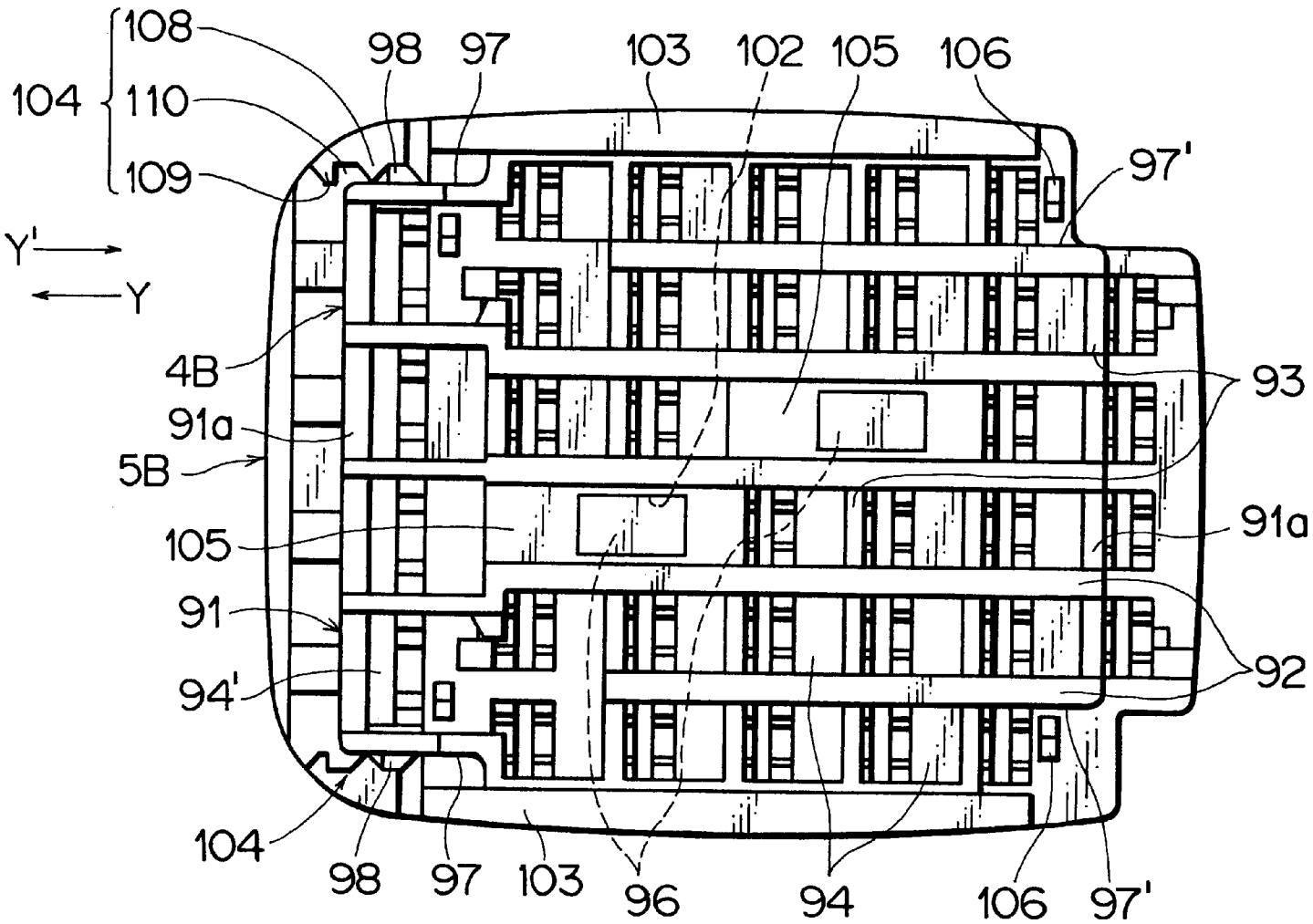
FIG. 21 is a view similar to FIG. 17, with the male terminal locking device slid from preliminary locked position to full locked position.
Figure 22:
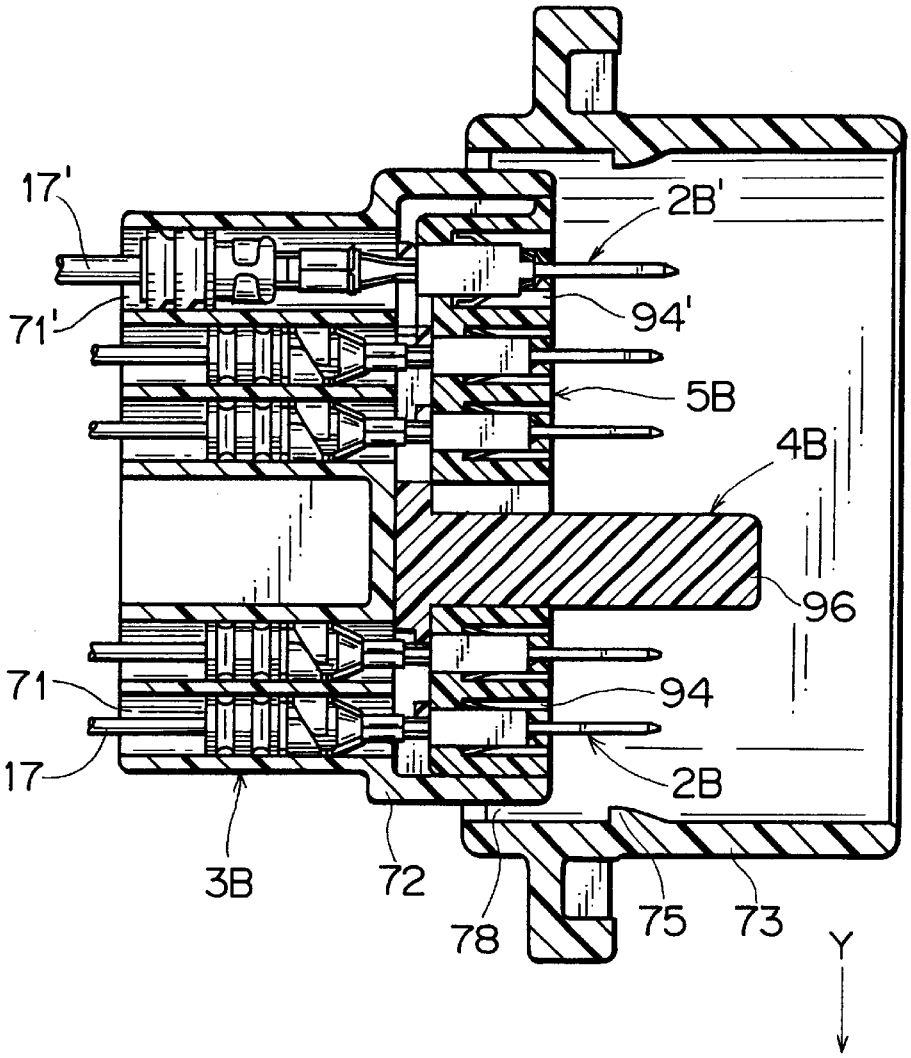
FIG. 22 is a view similar to FIG. 19, with the male terminal locking device slid in the direction Y to full locked position.
Figure 23:
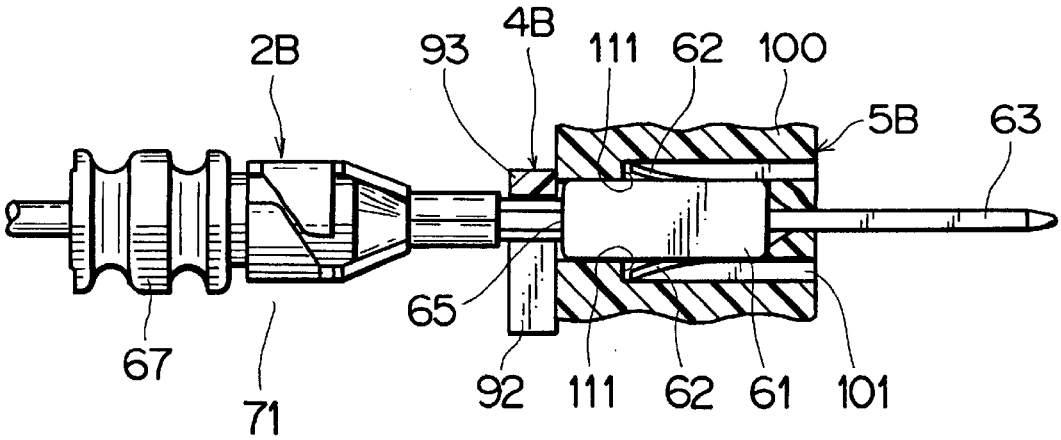
FIG. 23 is an enlarged view of a part of FIG. 22, with a male terminal.

Then, as shown in FIG. 19, the male terminal locking device 4B is operated at the pair of operating levers 96 and slid to the right (in the direction Y') so that its locking projections 98, as shown in FIG. 21, ride over the positioning projections 108 of the male terminal holder 5B and the male terminal locking device 4B is moved to full locked position on the male terminal holder 5B.

As shown in FIGS. 19 and 20, if a male terminal 2B has been fully inserted into a terminal receiving cavity 71, the related vertical wall 93, on sliding the male terminal locking device 4B, comes into engagement with the shoulder 65 of the male terminal 2B to double lock the male terminal 2B. In other words, on moving the male terminal locking device 4B from preliminary locked position to full locked position on the male terminal holder 5B, a male terminal 2B is double locked.

Figure 24:
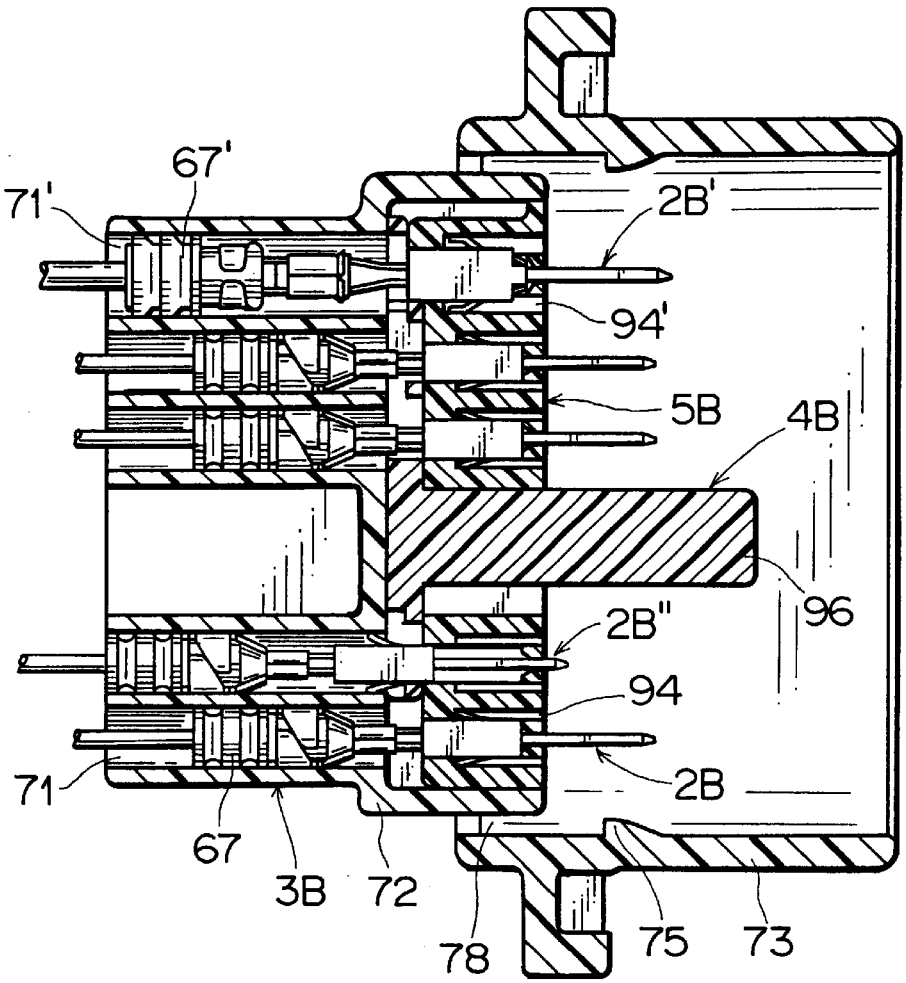
FIG. 24 is a view similar to FIG. 19, showing male terminals inserted into terminal receiving cavities, with one of the terminals incompletely inserted into the related terminal receiving cavity.
Figure 25:
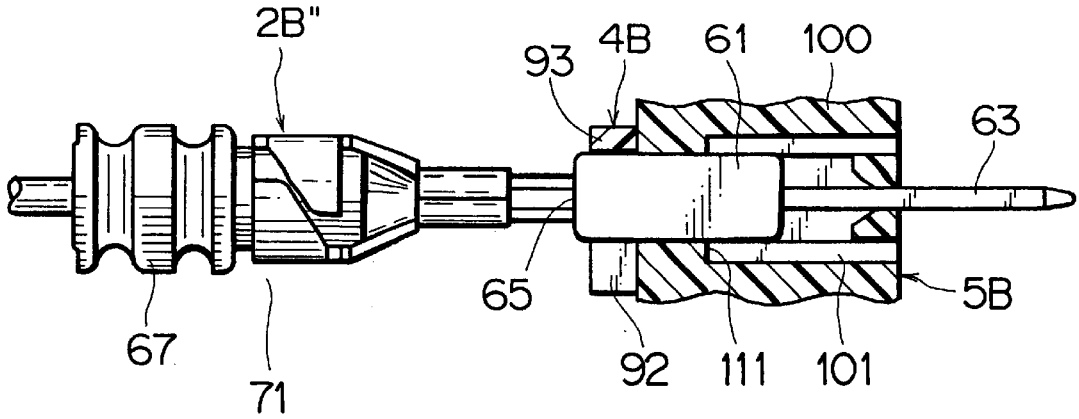
FIG. 25 is an enlarged view of a part of FIG. 24, with the incompletely inserted male terminal.

On the other hand, as shown in FIGS. 24 and 25, if a male terminal 2B is in incomplete inserted position in a terminal receiving cavity 71, the vertical wall 93 abuts against the terminal body 61 of the male terminal 2B and is prevented from engaging with the shoulder 69. In other words, the male terminal locking device 4B cannot be moved to full locked position on the male terminal holder 5B, and the male terminal 2B is not double locked, thereby enabling to detect the inserted condition of a male terminal 2B in a terminal receiving cavity 71 by whether or not the male terminal locking device 4B is movable to full locked position. Such an incompletely inserted male terminal 2B" may be pulled into position in the terminal receiving cavity 71 with a jig or the like.

Although dependent on the degree of incomplete insertion into a terminal receiving cavity 71, if the degree is small, such a male terminal 2B may be pushed into the related terminal insertion cavity 101 by a vertical wall 93 of the male terminal locking device 4B or vertical portion 91*a* of the frame body 91 being slid. In other words, such a male terminal 2B may be automatically moved from incomplete inserted position to full inserted position.

Figure 26:
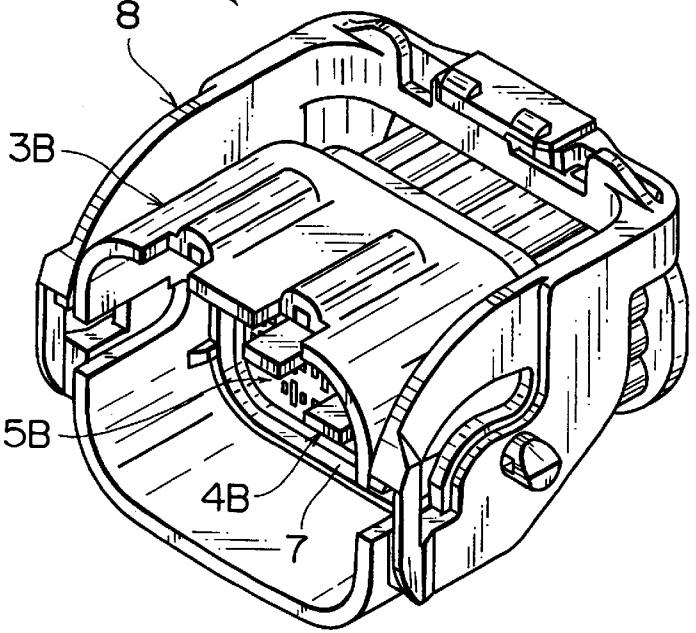
FIG. 26 is a perspective view of an assembled female connector, with a waterproof cover and a female terminal omitted.

As shown in FIG. 14, after male terminals 2B are double locked in terminal receiving cavities 71 or before inserting male terminals 2B into terminal receiving cavities 71, the seal packing 7 is fitted in the packing receiving space 78 inside the hood 73. Then, a waterproof cover 6B is assembled to the female housing body 70 by fitting the collar 74 of the female housing body 70 in the flange 52 of the waterproof cover 6B. A female connector 1B is thus assembled as shown in FIG. 26.

A method of assembling an electrical connector 1 with a terminal locking device (hereinafter simply referred to as an "electrical connector") from the male and female connectors 1A and 1B will now be described with reference to FIGS. 27 to 29.

Figure 27:
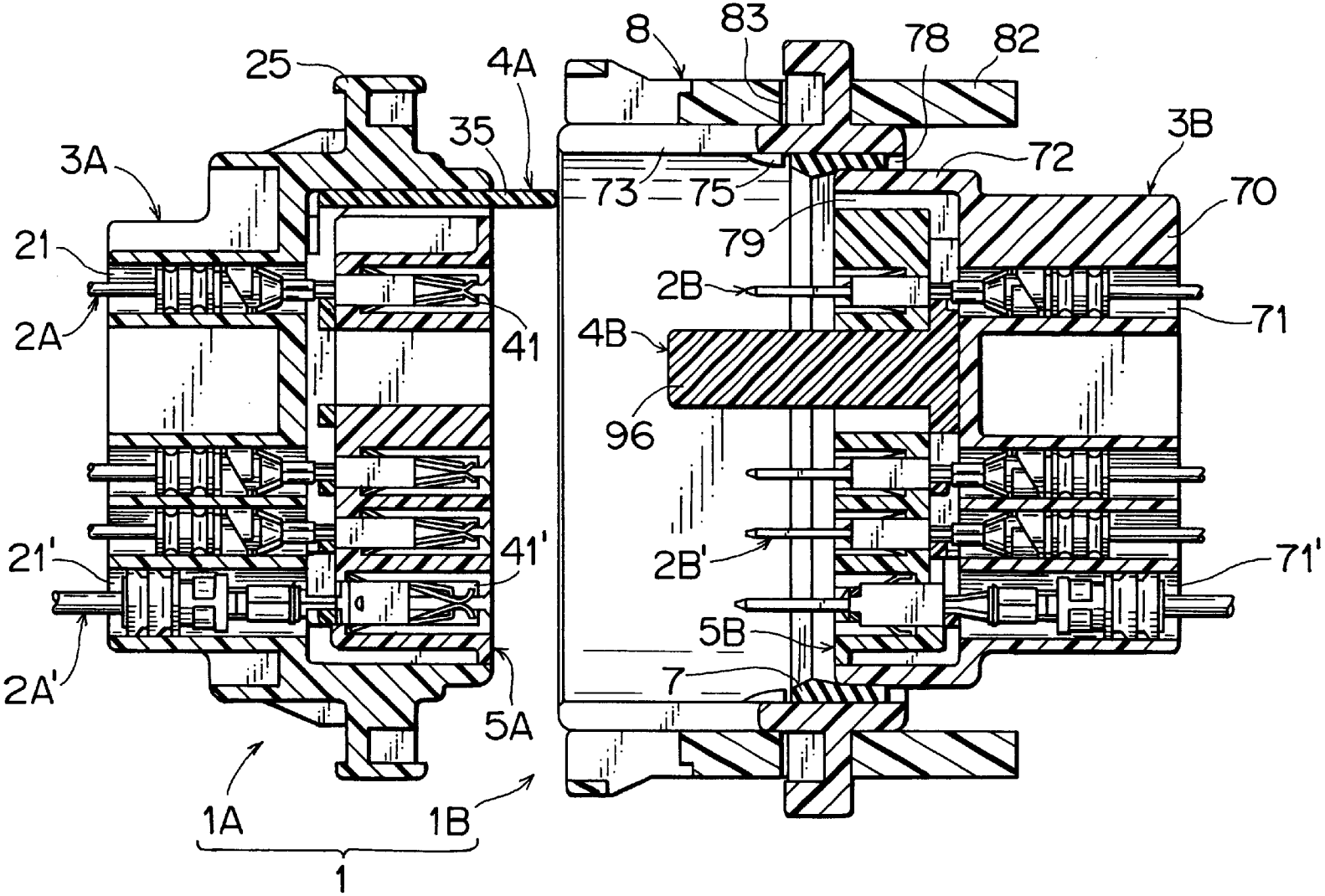
FIG. 27 is a view showing the male connector of FIG. 13 and the female connector of FIG. 26 prior to coupling with each other.
Figure 30:
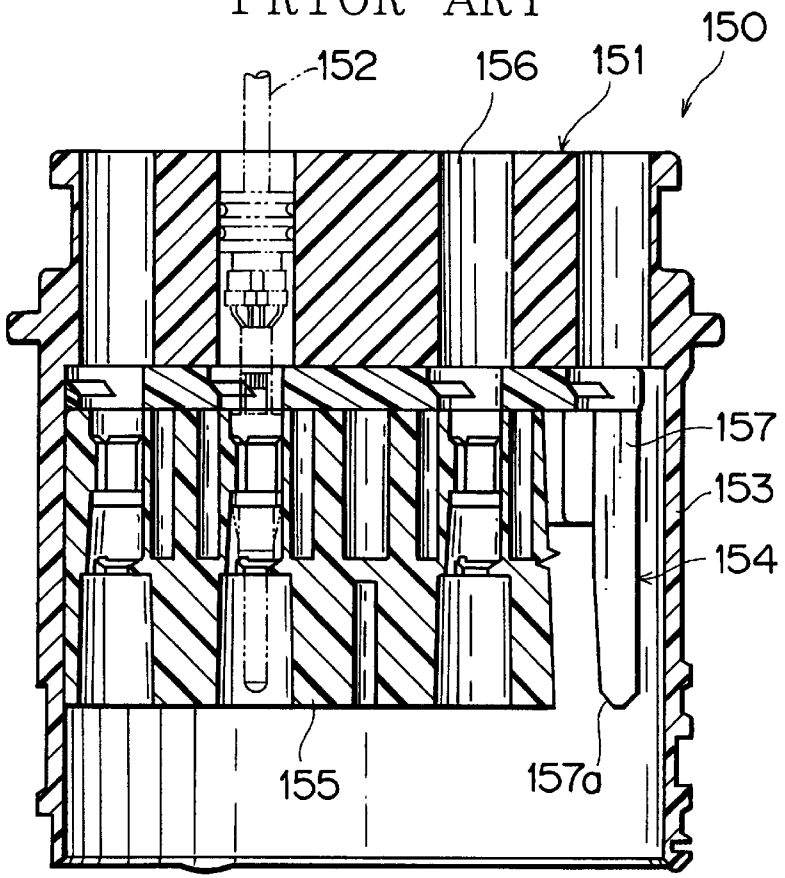
FIG. 30 PRIOR ART
FIG. 30 is an explanatory view of a conventional example.

As shown in FIG. 27, a lever receiving space 79 for receiving the operating lever 35 of a male terminal locking device 4A is formed inside the holder receiving section 72 of a female connector 1B, i.e., between the male terminal locking device 4B and the holder receiving section 72.

Figure 28:
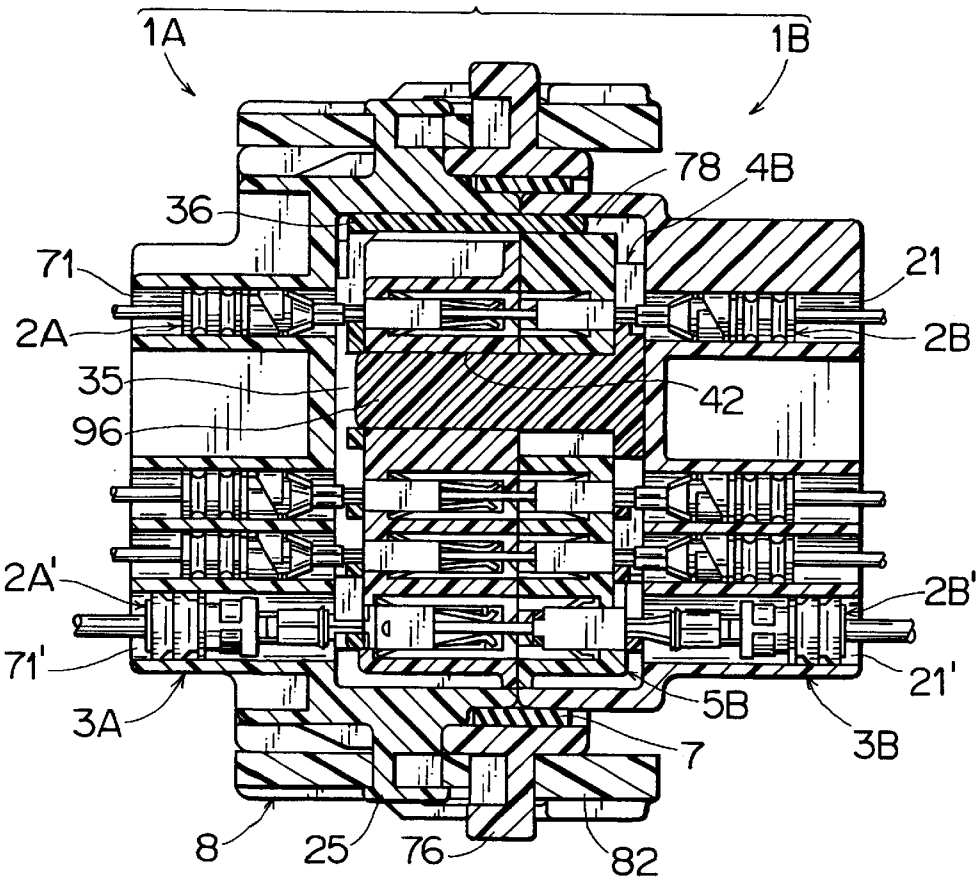
FIG. 28 is a view showing the male connector of FIG. 13 and the female connector of FIG. 26 coupled together.
Figure 29:
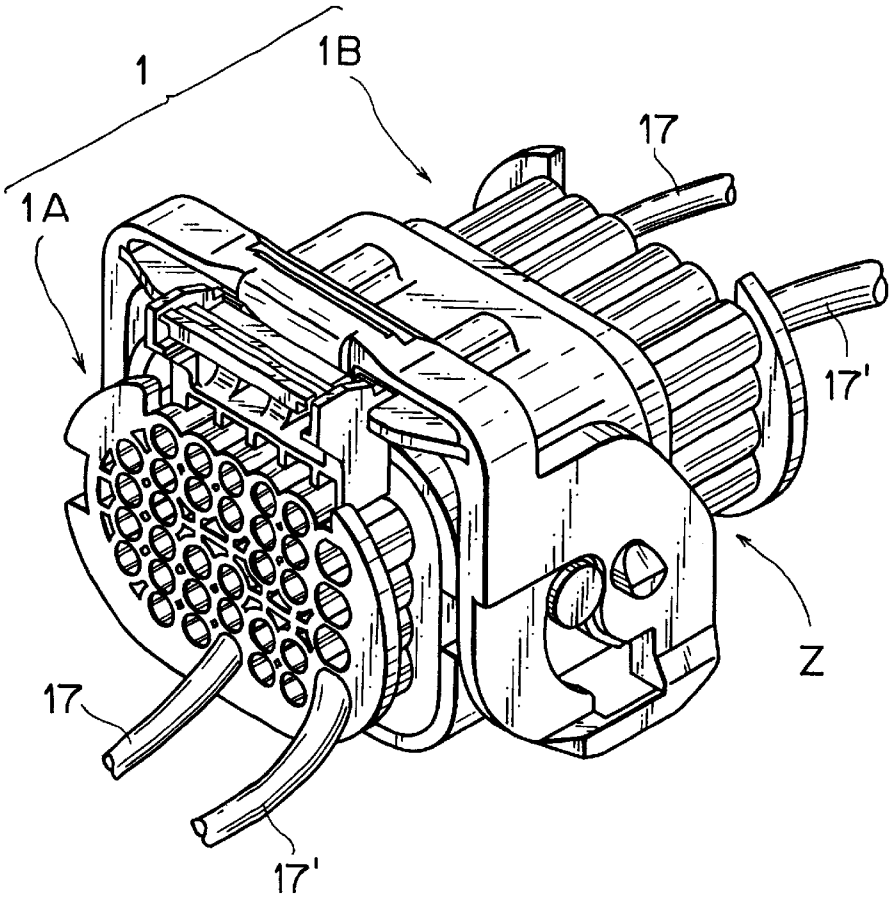
FIG. 29 is a perspective view of the male and female connectors of FIG. 28, with a waterproof cover and female and male terminals omitted.

As shown in FIG. 28 (FIGS. 1 and 14), the drive shafts 25 of the male connector 1A are introduced into the cam grooves 83 of the operating cam member 8 provided on the female connector 1B. The operating cam member 8 is rotated counterclockwise (in a direction Z) against the spring force, so that the male connector 1A moves into the hood 73 of the female connector 1B, with the guide projections 26 of the male connector 1A guided in the guide grooves 77 of the female connector 1B. As the operating cam member 8 is rotated, the tab-like contacts 63 of male terminals 2B are inserted into respective bifurcated contacts 13 of female terminal 2A. Then, the operating levers 96 of the female connector 1B advance through the lever receiving openings 42 of the female terminal holder 5A into the lever receiving openings 35 of the female terminal locking device 4A, and the operating lever 36 of the female terminal locking device 4A is received into the lever receiving space 78 of the female connector 1B.

On engaging the fitting plate 84 of the operating cam member 8 with the locking arm 23 of the male connector 1A, the male connector 1B is fully inserted into the hood 22 of the female connector 1A, and male terminals 2B inside the female connector 1B electrically connect to respective female terminals 2A inside the male connector 1A. In order to keep the male and female connectors 1A and 1B coupled together, a member (not shown) for that purpose is mounted (pushed in) under the locking arm 23. The member as mentioned above serves to insure the coupled condition as referred to above.

While in the present embodiment, as shown in FIGS. 1 and 14, the male and female connectors 1A and 1B are shown to be of a waterproof type, they are not limited to such. The cam means is not also limited to the operating cam member 8 as in the present embodiment. Further, a cam means is not indispensable to coupling the male connector 1A and the female connector 1B together.

Having now fully described the invention, it will be apparent to one of ordinary skill in the art that many changes and modifications can be made thereto without departing from the spirit and scope of the invention as set forth herein.

What is claimed is:

1. A male connector with a terminal locking device comprising:

a female terminal with a shoulder;

a male housing body with a terminal receiving cavity formed therein;

a holder receiving hood extending in an insertion direction of said female terminal into said terminal receiving cavity from an outer circumferential wall of said male housing body;

a female terminal holder having a terminal insertion cavity corresponding to said terminal receiving cavity, the female terminal holder assembled to said male housing body inside said holder receiving hood; and a female terminal locking device for detecting an inserted condition of said female terminal into said terminal receiving cavity, which is engaged at a side of said female terminal holder toward said male housing body to be slidable in a direction perpendicular to said insertion direction of said female terminal and has a terminal introducing opening corresponding to said terminal receiving cavity, wherein said female terminal locking device comprises a frame body which is engaged in preliminary and full locked positions on said female terminal holder; at least one vertical wall which extends across said frame body in a direction perpendicular to a sliding direction of said frame body to engage with said shoulder of said female terminal in full locked position; and an operating lever which extends from said frame body in said insertion direction of said female terminal and, when said female terminal locking device is located inside said holder receiving hood, the operating lever projects outside thereof.

2. A female connector with a terminal locking device comprising:

a male terminal with a shoulder;

a female housing body with a terminal receiving cavity formed therein;

a hood extending in an insertion direction of said male terminal into said terminal receiving cavity from an outer circumferential wall of said female housing body;

a holder receiving section formed between said female housing body and said hood;

a male terminal holder assembled to said female housing body inside said holder receiving section and has a terminal insertion cavity corresponding to said terminal receiving cavity; and a male terminal locking device for detecting an inserted condition of said male terminal into said terminal receiving cavity, which is engaged at a side of said male terminal holder toward said female housing body to be slidable in a direction perpendicular to said insertion direction of said male terminal and has a terminal introducing opening corresponding to said terminal receiving cavity.

3. The female connector according to claim 2, wherein said male terminal locking device comprises a frame body which is engaged in preliminary and full locked positions on said male terminal holder; at least one vertical wall by which said male terminal passes through said frame body when in preliminary locked position and which extends across said frame body in a direction perpendicular to a sliding direction of said frame locked position; and at least one operating lever which extends from said vertical wall in said insertion direction of said male terminal.

4. The female connector according to claim 3, wherein said operating lever is located substantially at a center of said male terminal locking device and projects through said male terminal holder into said hood to prevent distortion of said male terminal when said male terminal is passed through said terminal insertion cavity in preliminary locked position.

5. An electrical connector assembly having a male connector and a female connector, said male connector comprising: a female terminal with a shoulder; a male housing body with a terminal receiving cavity formed therein; a holder receiving hood extending in an insertion direction of said female terminal into said terminal receiving cavity from an outer circumferential wall of said male housing body; a female terminal holder having a terminal insertion cavity corresponding to said terminal receiving cavity, which is assembled to said male housing body inside said holder receiving hood; and a female terminal locking device for detecting an inserted condition of said female terminal into said terminal receiving cavity, the female terminal locking device engaged at a side of said female terminal holder toward said male housing body to be slidable in a direction perpendicular to said insertion direction of said female terminal and has a terminal introducing opening corresponding to said terminal receiving cavity, said female connector comprising: a male terminal with a shoulder; a female housing body with a terminal receiving cavity formed therein; a hood extending in an insertion direction of said male terminal into said terminal receiving cavity from an outer circumferential wall of said female housing body; a holder receiving section formed between said female housing body and said hood; a male terminal holder which is assembled to said female housing body inside said holder receiving section and has a terminal insertion cavity corresponding to said terminal receiving cavity; and a male terminal locking device for detecting an inserted condition of said male terminal into said terminal receiving cavity, the male terminal locking device engaged at a side of said male terminal holder toward said female housing body to be slidable in a direction perpendicular to said insertion direction of said male terminal and has a terminal introducing opening corresponding to said terminal receiving cavity, wherein said female terminal holder further comprises a lever receiving opening for receiving an operating lever of said male terminal locking device when said male connector is fitted in said hood of said female connector to be coupled with said female connector, and said female connector further comprises lever receiving openings formed in said female terminal holder in the lever receiving section openings of the female terminal locking device and the operating lever of the female terminal locking device is received into the lever receiving space of the female connector.

6. The electrical connector assembly according to claim 5, wherein said female terminal locking holder of said male connector further comprises a lever receiving opening formed therein which corresponds to said lever receiving opening of said female terminal holder.

7. The electrical connector assembly according to claim 5, further comprising a cam mechanism which allows said female connector and said male connector to be coupled with a low force.

8. The electrical connector assembly according to claim 6, wherein said male connector and said female connector are of a waterproof type.

* * * * *